US008935995B1

(12) United States Patent
Hawkins

(10) Patent No.: US 8,935,995 B1
(45) **Date of Patent: *Jan. 20, 2015**

(54) WHEELED, MANUALLY MOVEABLE ELECTRIC GENERATOR

(76) Inventor: Bobby L. Hawkins, Travelers Rest, SC (US)

( * ) Notice: Subject to any disclaimer, the term of this patent is extended or adjusted under 35 U.S.C. 154(b) by 967 days.

This patent is subject to a terminal disclaimer.

(21) Appl. No.: 12/684,249

(22) Filed: Jan. 8, 2010

Related U.S. Application Data

(60) Provisional application No. 61/148,579, filed on Jan. 30, 2009, provisional application No. 61/115,276, filed on Feb. 10, 2009, provisional application No. 61/218,292, filed on Jun. 18, 2009, provisional application No. 61/231,816, filed on Aug. 6, 2009.

(51) Int. Cl.
*F02B 63/00* (2006.01)

(52) U.S. Cl.
USPC ..... 123/2; 123/3; 248/27.3

(58) Field of Classification Search
USPC ..... 123/2, 3, 198 E; 180/218; 248/27.3
See application file for complete search history.

(56) References Cited

U.S. PATENT DOCUMENTS

| | | | | | |
|---|---|---|---|---|---|
| 2,789,756 | A | * | 4/1957 | Allen | 137/899.4 |
| 2,812,041 | A | * | 11/1957 | Mugler | 188/74 |
| 3,116,596 | A | * | 1/1964 | Voris et al. | 60/307 |
| RE28,936 | E | * | 8/1976 | Talamantez | 280/5.2 |
| 4,173,951 | A | | 11/1979 | Ishihara | |
| 4,534,118 | A | * | 8/1985 | Cabus et al. | 34/514 |
| 4,548,164 | A | | 10/1985 | Ylönen et al. | |
| 4,595,841 | A | | 6/1986 | Yaguchi | |
| 4,859,886 | A | | 8/1989 | Tanaka et al. | |
| 5,051,837 | A | * | 9/1991 | McJunkin | 725/26 |
| 5,355,075 | A | | 10/1994 | Wilson, III | |
| 5,598,323 | A | * | 1/1997 | Muller | 361/726 |
| 5,924,393 | A | * | 7/1999 | Kikuchi | 123/2 |
| 6,139,029 | A | * | 10/2000 | Shaw | 280/8 |
| 6,313,543 | B1 | * | 11/2001 | Frank | 290/1 A |
| 6,534,958 | B1 | * | 3/2003 | Graber et al. | 322/11 |
| D478,311 | S | | 8/2003 | Yaguchi et al. | |
| 6,737,775 | B2 | | 5/2004 | Hatz et al. | |
| 6,750,556 | B2 | * | 6/2004 | Sodemann et al. | 290/1 A |
| 6,758,169 | B2 | * | 7/2004 | Suzuki et al. | 123/3 |
| 6,923,475 | B1 | * | 8/2005 | Martin et al. | 280/789 |

(Continued)

OTHER PUBLICATIONS

Battery Reference Book by Thomas P J Crompton, May 25, 2000, p. 47/14.*

(Continued)

*Primary Examiner* — Lindsay Low
*Assistant Examiner* — Omar Morales
(74) *Attorney, Agent, or Firm* — Dority & Manning, P.A.

(57) ABSTRACT

A wheeled, manually movable, internal combustion engine powered electric generator is mounted in a rigid frame formed of tubular steel elements. A pair of aligned wheels is pivotally mounted to each opposite side of the frame, and one pair has a locking mechanism. The electricity generating components are mounted to the bottom of the frame. The battery and trickle charger are carried above the engine in a locked compartment. The engine's muffler is disposed beneath the upper outline of the engine to free space for accommodating the battery and the fuel tank, which is completely within the outline of the frame and holds more than 12 gallons of diesel fuel. The frame also supports and contains a locked compartment that houses the electric connector that is used to connect the electric output of the generator to the load.

20 Claims, 37 Drawing Sheets

(56) References Cited

U.S. PATENT DOCUMENTS

| | | | | |
|---|---|---|---|---|
| 7,089,889 | B2 * | 8/2006 | Johnson et al. | 123/2 |
| 7,224,578 | B2 | 5/2007 | Buck et al. | |
| 7,475,888 | B2 * | 1/2009 | Craig et al. | 280/47.18 |
| 7,490,847 | B2 * | 2/2009 | Dahl | 280/638 |
| D595,227 | S * | 6/2009 | Hawkins | D13/116 |
| D597,944 | S * | 8/2009 | Takamura | D13/116 |
| 7,673,589 | B2 * | 3/2010 | Shimada et al. | 123/2 |
| 8,134,244 | B2 * | 3/2012 | Wurth | 290/1 A |
| 2004/0168654 | A1 * | 9/2004 | Radtke | 123/2 |
| 2006/0186624 | A1 * | 8/2006 | Kady | 280/47.18 |
| 2006/0214425 | A1 * | 9/2006 | Yamamoto et al. | 290/1 A |
| 2008/0111013 | A1 * | 5/2008 | Suckle et al. | 242/370 |
| 2008/0202447 | A1 * | 8/2008 | Kochi et al. | 123/2 |
| 2009/0284022 | A1 * | 11/2009 | Usselman et al. | 290/38 R |

OTHER PUBLICATIONS

Owner'S Manual, Model TG 9000ES Industrial Generator, Titan Industries, Revision #030321A, Mar. 27, 2003.

* cited by examiner

WHEELED, MANUALLY MOVEABLE ELECTRIC GENERATOR

CROSS-REFERENCE TO RELATED APPLICATIONS

This application claims benefit to the following U.S. provisional patent applications: Ser. No. 61/148,579 filed Jan. 30, 2009; Ser. No. 61/115,276 filed Feb. 10, 2009; Ser. No. 61/218,292 filed Jun. 18, 2009; and Ser. No. 61/231,816 filed Aug. 6, 2009.

STATEMENT REGARDING FEDERALLY SPONSORED RESEARCH OR DEVELOPMENT

N/A

BACKGROUND OF THE INVENTION

This application pertains to electric generators that have wheels by which they can be moved manually and that are powered either by a diesel engine or a gasoline engine.

Electric generators powered by a diesel engine are known, and many examples can be found, including U.S. Pat. Nos. 6,737,775 and 7,224,578, which by this reference are hereby incorporated herein for all purposes.

A typical portable electric generator is mounted in a frame. The electricity generating components, i.e., the engine (whether powered by diesel fuel or gasoline) and the electric stator and rotor, which are the heaviest components, are mounted to the bottom of the frame. The engine typically will be mounted toward the rear end of the frame, and the electric stator and rotor will be mounted toward the front end of the frame. The battery for the engine typically also is mounted to the bottom of the frame as one of the heavier components.

At least one axle typically will be mounted at one lower end of the rear of the frame with a wheel on each opposite end of the axle that carries the rear end of the frame and up to half the weight of the generator unit. Opposite the rear end of the frame having the axle and wheels, the front end of the frame typically will have a pair of stationary vertical support feet to carry the other portion of the weight of the generator unit.

A front handle typically will be mounted on the upper portion of the front of the frame. The handle can be pivotally mounted to the frame so that when not in use it can be folded down flush with the front of the frame. The front handle can be used to lift the stationary end of the frame and pull the generator unit on the two wheels at the rear end of the frame.

The fuel tank for a wheeled, manually movable internal combustion engine powered electric generator typically will hold about 3½ gallons of diesel fuel, but ten gallon tanks have been known. The fuel tank and the engine's muffler typically are mounted above the engine, and the muffler discharges above the engine. The full weight of a typical portable diesel engine powered electric generator unit with a nine horsepower diesel engine and a full 3½ gallons of diesel fuel is about 280 pounds, assuming that the density of diesel fuel is about 7.09 pounds per US gallon. Because gasoline weighs about 6.073 pounds per US gallon and gasoline engines tend to weigh less than diesel engines, the full weight of a typical portable gasoline engine powered electric generator unit with an eleven and one half horsepower gasoline engine and a full 3½ gallons of gasoline is about 200 pounds.

OBJECTS AND SUMMARY OF THE INVENTION

It is a principal object of the present invention to provide a wheeled, manually movable, internal combustion engine powered electric generator that can operate continuously for at least 24 hours on a single tank of fuel and yet be capable of being moved off-road to negotiate across relatively rough terrain by one or two men on foot.

It also is a principal object of the present invention to provide a wheeled, manually movable, internal combustion engine powered electric generator that quickly and easily can be partially disassembled for ease of shipment and storage and re-assembled once arriving on site for operation.

It is another principal object of the present invention to provide a wheeled, manually movable, internal combustion engine powered electric generator that can operate continuously for at least 24 hours on a single tank of fuel and yet be capable of being deployed in remote terrain with its portable components relatively secure against theft.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out throughout this patent application.

To achieve the objects and in accordance with the purpose of the invention, as embodied and broadly described herein, a wheeled, manually movable, diesel engine powered (or gasoline engine powered) electric generator is mounted in a rigid frame formed of tubular steel elements. The electricity generating components, i.e., the internal combustion engine (diesel or gasoline) and the electric stator and rotor, which are the heaviest components, desirably are mounted to the bottom of the frame. The internal combustion engine (diesel or gasoline) desirably is mounted toward the front end of the frame, and the electric stator and rotor desirably are mounted toward the rear end of the frame. The battery for the engine desirably is carried above the engine by the upper rear portion of the frame and secured in a compartment with a hinged cover that locks in the closed position. The fuel tank desirably is mounted to the rear of the frame above the electric stator and rotor, and the upper surface of the fuel tank desirably is disposed flush with the uppermost elements of the frame.

A retractable handle desirably is mounted to the upper portion of the front end of the frame to facilitate lifting of the unit when necessary to negotiate past obstacles that cannot be negotiated with the unit being pushed or pulled on the wheel set. A locking front panel desirably is provided to enable the user to selectively lock the front handle in the fully extended horizontal position. The interior surface of the locking front panel desirably can be provided with sound insulation, which deadens the noise of the generator when the handle and front panel are retracted to their positions against the front of the generator. A retractable, twin grip handle desirably is mounted to the upper portion of the rear end of the frame. The twin grip handle also desirably can be locked in the upright horizontal position so that when the user stops gripping the handles, they remain in the upright horizontal position. The interior surface of a rear panel also desirably can be provided with sound insulating material.

A pair of aligned wheels is pivotally mounted to each opposite side of the frame such that the pivot point will be disposed between the front end of the frame and the center of gravity of the overall unit, both with an empty fuel tank and with a full tank of fuel. A lifting pivot pin desirably can be provided on each of the left and right wheel supports to facilitate lifting the rear set of wheels in order to negotiate elevated obstacles and to facilitate pivoting the generator left and right on the front set of wheels.

At least one pair of aligned wheels desirably can be provided with a locking mechanism that enables both the front and rear wheels to be locked against rotation once the unit is situated where desired next to a cell tower that has batteries that would need to be recharged by the electricity generated by the generator unit. The wheel locks desirably can be disposed on only one pair of aligned wheels so that if disposed on an incline, the side of generator without the locked wheels will tend to arc in a circle rather than follow the pull of gravity down the incline.

The upper rear portion of the frame houses a fuel tank completely within the outline of the frame, and the fuel tank desirably holds more than 12 gallons of diesel fuel or gasoline. The fill cap of the fuel tank has a mechanism to lock the cap to the tank. The upper front portion of the frame also desirably supports and contains a power compartment that houses the electric connector and associated power cord that are used to connect the electric output of the generator to the load. A hinged cover desirably encloses the power compartment, and a lock desirably is provided to secure the cover in the closed position. The front wall portion of the power compartment desirably is configured to permit the cover to be closed and locked while the connector is disposed outside the compartment and connected to the load.

The upper front section of the frame also houses a battery compartment in which the direct current battery for the diesel engine or gasoline engine is housed together with a trickle charger that is electrically connected to the battery. The battery compartment also desirably is provided with a hinged cover that is provided with a locking mechanism. The control panel for the connector desirably is housed beneath the fuel tank on one side of the frame. Hinged and lock-bearing side panels desirably provide doors that selectively govern access to the run/stop switch of the generator and to the control panel for the electrical connector. The interior surfaces of the side panels also desirably can be provided with sound insulating material. Desirably, a single key operates all of the locking mechanisms provided on the generator.

The exhaust muffler of the engine (diesel or gasoline) desirably is mounted along one side of the housing for the stator and rotor and discharges to the side of the generator unit. The exhaust muffler for the engine (diesel or gasoline) desirably is disposed in the lower section of the compartment and beneath the upper outline of the engine in order to free space for accommodating the fuel tank and the battery compartment. A side exhaust housing desirably is provided to shield from damage the side exhaust pipe connected to the exhaust muffler. The side exhaust housing desirably is mounted to a lower left side panel, and sound insulating material that deadens the noise of the operating generator desirably is provided on the interior facing surface of the lower left side panel.

The air filter for the engine (diesel or gasoline) desirably has an inwardly facing scoop that significantly diminishes the noise generated by operation of the engine.

Each of the uppermost surfaces of the upper crossbraces of the generator's frame desirably carries a pair of stacking disks that enable one generator to be stacked on top of another generator during shipping. A hand guard panel desirably is attached to the front right vertical leg of the frame near the diesel engine and desirably is provided with a plurality of openings that facilitate air circulation but are not so large that a person could put one's hands through the openings and be harmed by operation of the engine.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, several examples of which being illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of what could be claimed and equivalents thereof. The same numerals are assigned to the same components throughout the drawings and description.

Figure 1:
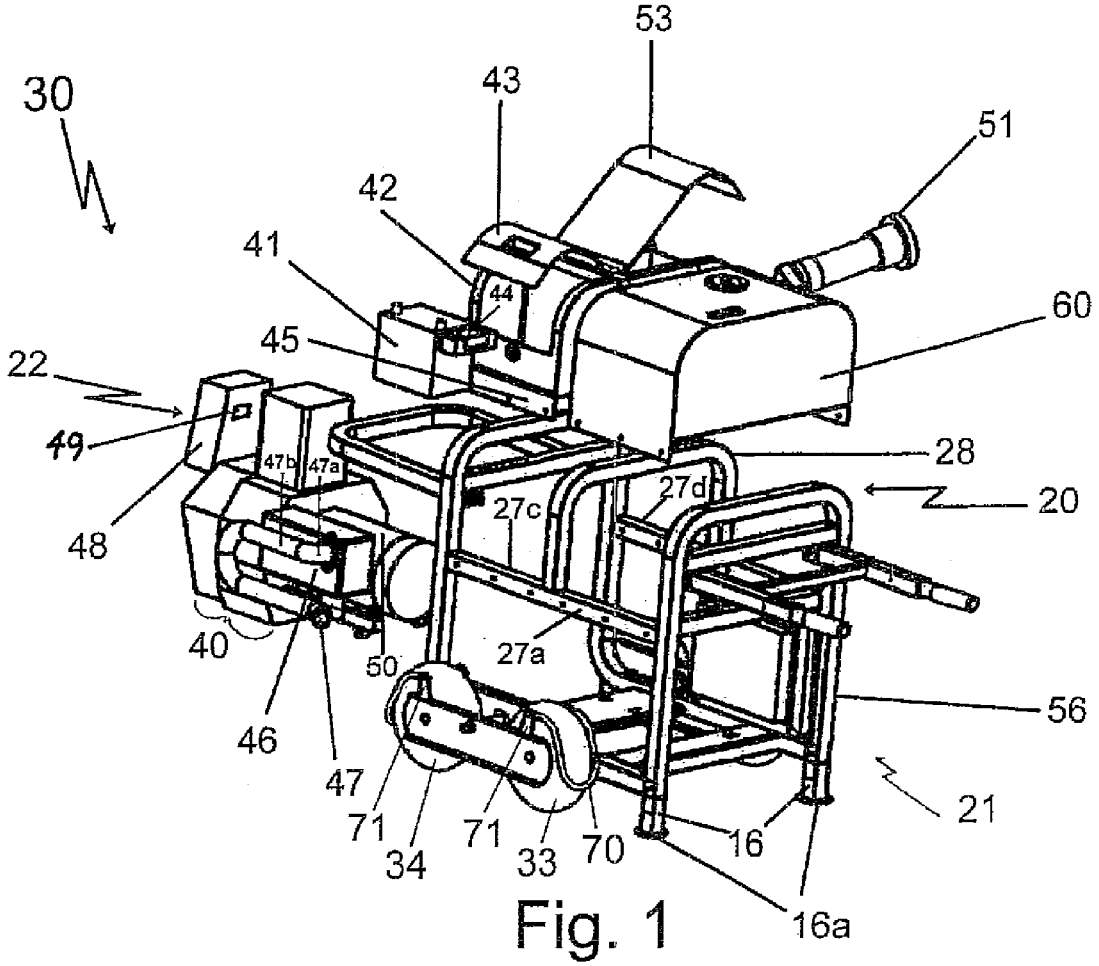
FIG. 1 is an elevated perspective view of the rear and left side of assembled components of a partially assembled, preferred embodiment of the wheeled, manually movable, internal combustion engine powered electric generator of the present invention.

One of the presently preferred embodiments of the wheeled, manually movable, internal combustion engine powered electric generator is shown in FIG. 1 and is represented generally by the numeral 30. The wheeled, manually movable, internal combustion engine powered electric generator includes a rigid frame generally designated by the numeral 20, and the frame 20 is desirably formed of 16 gauge tubular steel elements. As shown in FIG. 1, the frame 20 defines an axial direction from a rear end 21 to a front end 22, which is disposed opposite the rear end 21. The frame 20 further defines a transverse direction orthogonal to the axial direction. The frame further defines a first side and a second side spaced apart in the transverse direction from the first side. Either of the front end 22 and the rear end 21 can be considered to be either of the first end and the second end or vice versa. Similarly, either of the first side and the second side can be considered to be either of the left side and the right side. For example, viewed from the perspective of the generator (as opposed to the perspective of the viewer looking at the generator), the first side can be considered to be the right side of the generator 30, and the second side can be considered to be the left side of the generator 30. In the views shown in FIGS. 1-4, some of the components of the wheeled, manually movable, internal combustion engine powered electric generator 30 are shown pulled away from the frame 20.

Figure 7:
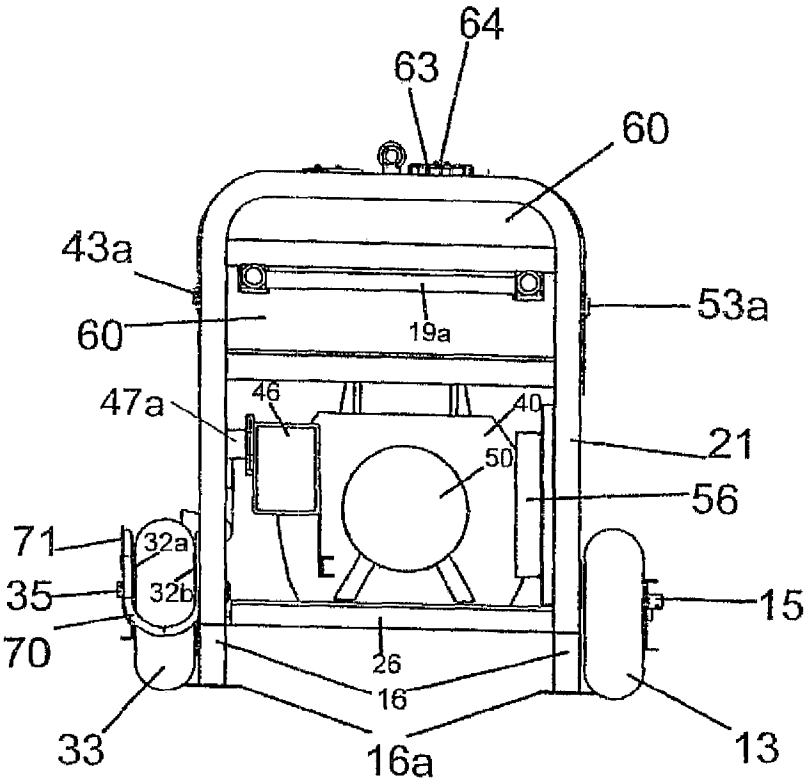
FIG. 7 is a rear, head-on view of assembled components of a partially assembled, preferred embodiment of the wheeled, manually movable, internal combustion engine powered electric generator of the present invention.
Figure 10:
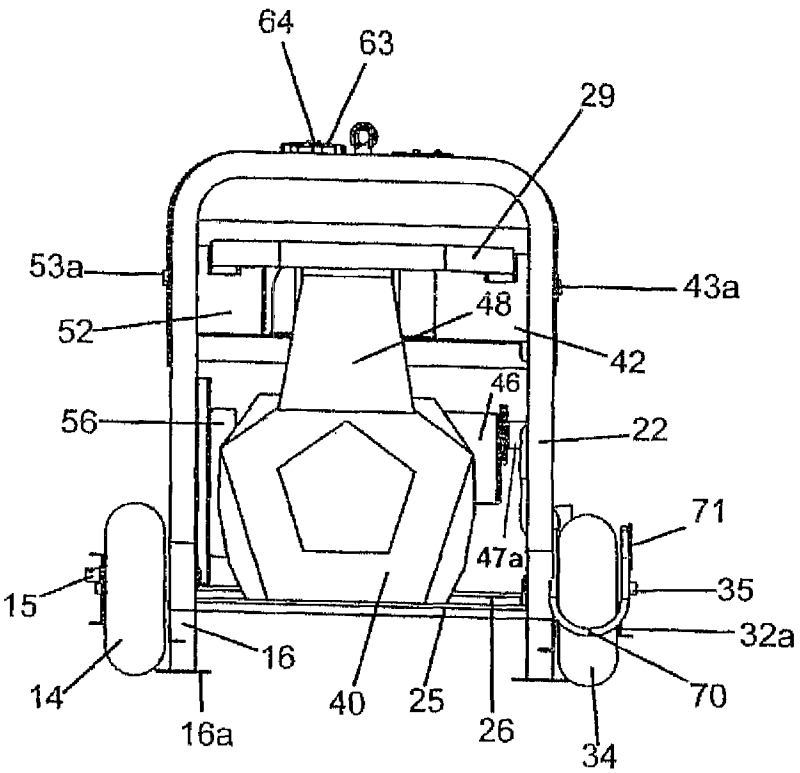
FIG. 10 is a head-on view of the front of components of a partially assembled, embodiment of the wheeled, manually movable, internal combustion engine powered electric generator of the present invention.

As shown in FIGS. 7 and 10 for example, in addition to the frame 20, the wheeled, manually movable, internal combustion engine powered electric generator 30 comprises an internal combustion engine 40 and an electric generator, which is not visible due to the surrounding housing 50. As shown in FIG. 1, the electric generator within the housing 50 is connected mechanically to be driven by the engine 40. As is conventional, the electric generator desirably can include a stator and a rotor that is rotatably disposed with respect to the stator and connected to be rotatably driven by an output shaft of the internal combustion engine, the details of which arrangement being conventional and thus not depicted in the drawings.

Figure 5:
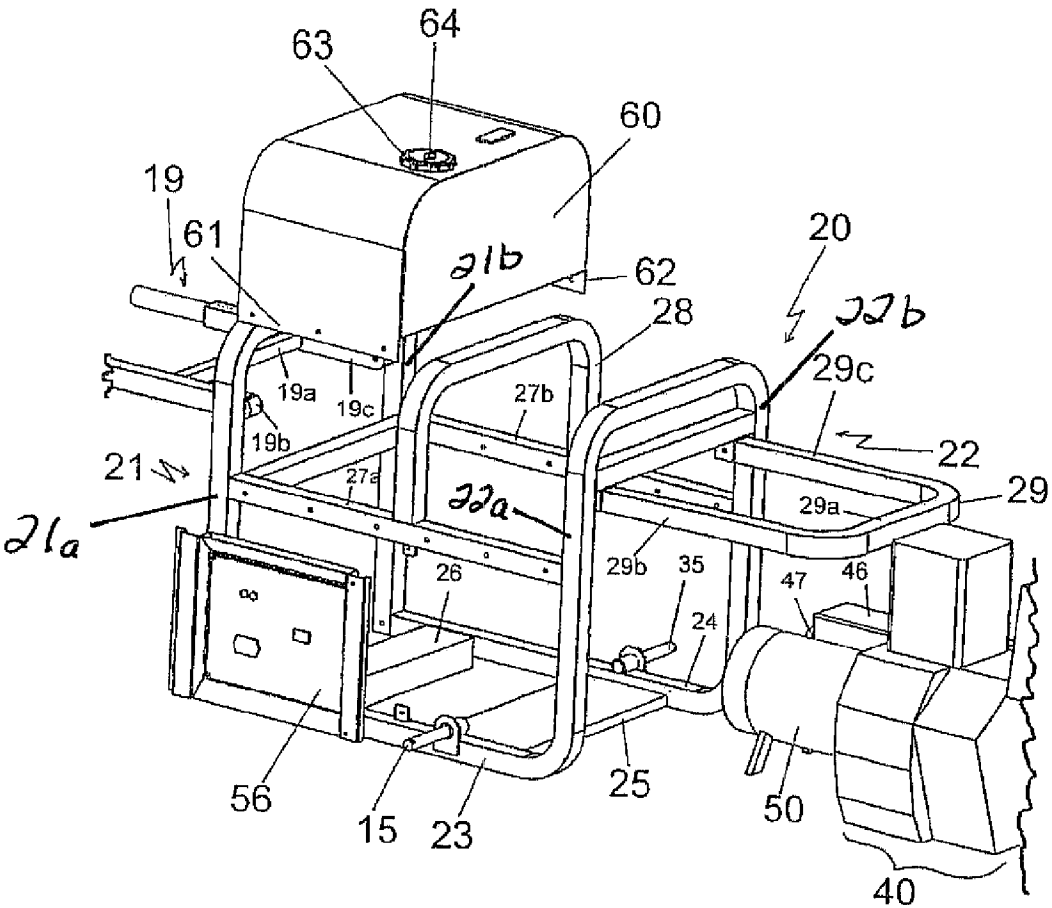
FIG. 5 is an elevated perspective partial view from the right front of components of a partially assembled, embodiment of the wheeled, manually movable, internal combustion engine powered electric generator of the present invention.

As shown in FIG. 5, the frame 20 desirably is divided into an upper portion and a lower portion. The lower portion of the frame includes the bottom of the frame, which can include a right bottom rail 23 and a left bottom rail 24. One side end of a front bottom panel 25 can be connected in a conventional manner (welded or mechanical fasteners) to the right bottom rail 23, and the opposite side end of the front bottom panel 25 can be connected to the left bottom rail 24. When assembled as shown in FIG. 10 for example, the internal combustion engine 40 is mounted toward the front end 22 of the frame 20 and is carried by and connected to the front bottom panel 25. One side end of a rear bottom panel 26 can be connected to the right bottom rail 23, and the opposite side end of the rear bottom panel 26 can be connected to the left bottom rail 24. When assembled as shown in FIG. 7 for example, the housing 50 for the electric stator and electric rotor is mounted toward the rear end 21 of the frame 20 and is carried by and connected to the rear bottom panel 26. The internal combustion engine 40 and the electric stator and rotor, which are the heaviest components, are thus carried by the bottom of the frame 20. The internal combustion engine 40 desirably is mounted toward the front end 22 of the frame 20, and the electric stator and rotor desirably are mounted toward the rear end 21 of the frame 20.

Figure 11A:
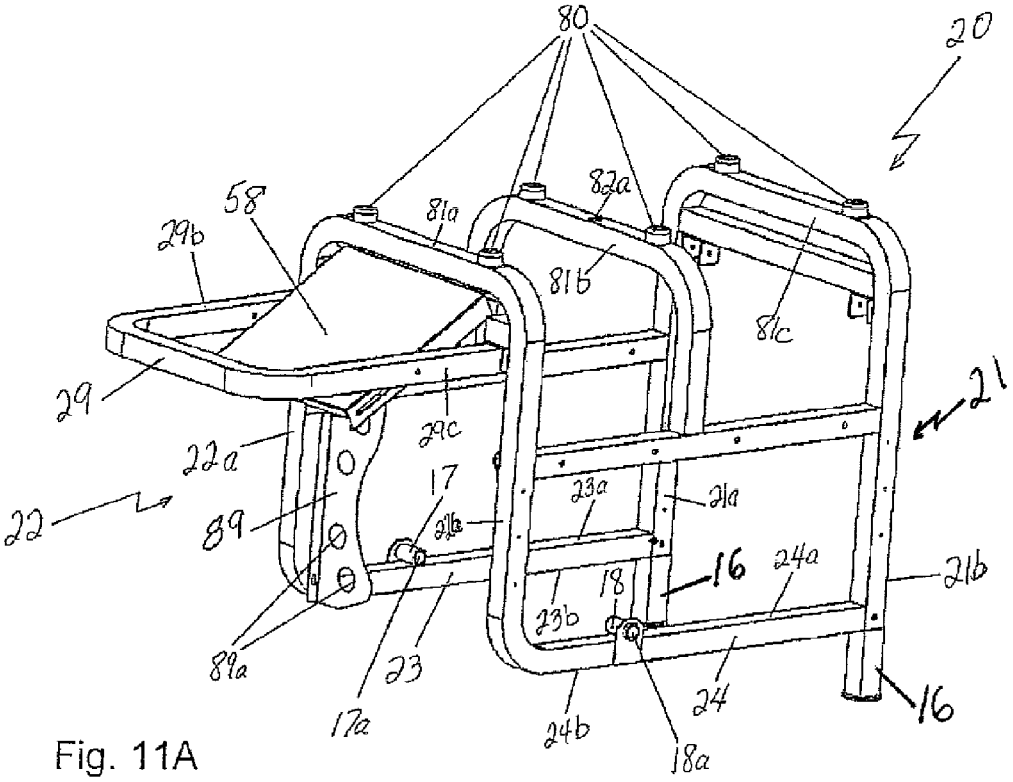
FIG. 11A is an elevated perspective view of from the left front of a frame component of a presently preferred embodiment of the wheeled, manually movable, internal combustion engine powered electric generator of the present invention.

As shown in FIG. 11A for example, the upper portion of the frame 20 desirably includes at least one upper crossbrace 81*a* extending transversely between the frame's first side and second side. The frame 20 desirably includes two additional upper crossbraces 81*b*, 81*c* that desirably are disposed parallel to the first upper crossbrace 81*a* and spaced apart therefrom and from each other. The uppermost surfaces of the upper crossbraces 81*a*, 81*b*, 81*c* of the frame define the uppermost surfaces of the frame 20.

As shown in FIGS. 5 and 11A, the frame desirably can include a right front upright member 22*a* having a lower end connected to or unitary with the front end of the right bottom rail 23. The right front upright member 22*a* has an upper end connected to or unitary with a right end of the forwardmost upper crossbrace 81*a*. Similarly, the frame desirably can include a left front upright member 22*b* that has a lower end connected to or unitary with the front end of the left bottom rail 24. The left front upright member 22*b* has an upper end connected to or unitary with a left end of the forwardmost upper crossbrace 81*a*.

As shown in FIGS. 5 and 11A, the frame desirably can include a right rear upright member 21*a* having a lower end connected to or unitary with a right rear support leg 16 and the rear end of the right bottom rail 23. The right rear upright member 21*a* has an upper end connected to or unitary with a right end of the rearwardmost upper crossbrace 81*c*. Similarly, the frame desirably can include a left rear upright member 21*b* that has a lower end connected to or unitary with a left rear support leg 16 and the rear end of the left bottom rail 24. The left rear upright member 21*b* has an upper end connected to or unitary with a left end of the rearwardmost upper crossbrace 81*c*. In a presently preferred embodiment, the length of the unit 30 measured between the front edge of the left front member 22*b* and the rear edge of the left rear member 21*b* desirably is about twenty-eight and seven eighths inches.

As shown in FIG. 5 for example, a fuel tank 60 for the engine 40 desirably is mounted to the upper portion of the rear end 21 of the frame 20 above where the housing 50 for the electric stator and rotor will reside in the assembled unit 30. The fuel tank 60 desirably nests between the upper portion of the rear end 21 of the frame 20 and a vertical mid brace 28 of the frame 20. As shown in FIG. 5, the fuel tank 60 desirably can be provided with a pair of lower attachment flanges 61, 62 that can be secured to respective rear sections 27*a*, 27*b* of respective horizontal mid braces of the frame 20. As shown in FIG. 5 for example, a fill cap 63 of the fuel tank 60 desirably has a locking mechanism 64 to lock the cap 63 to the tank 60. The fuel tank 60 is connected via a fuel line (not shown) to the engine 40 in conventional fashion. The fuel tank desirably holds more than 12 gallons of fuel and desirably holds 12.3 gallons of fuel (diesel or gasoline). When fully assembled, the upper surface of the fuel tank 60 desirably is disposed flush with the uppermost elements of the frame 20, and thus the upper rear portion of the frame 20 houses the fuel tank 60 completely within the outline of the frame 20.

Figure 11B:
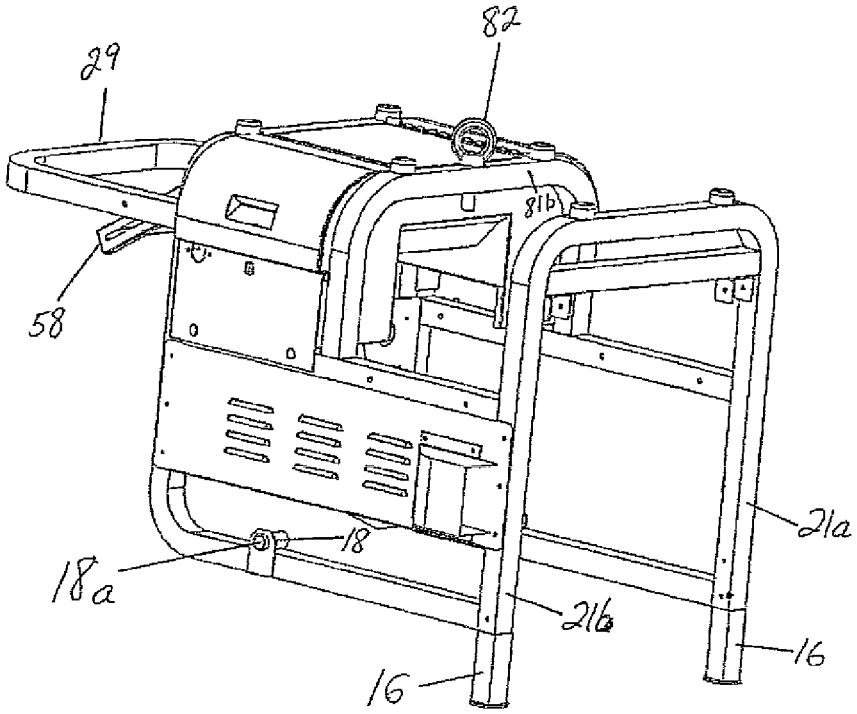
FIG. 11B is an elevated perspective view of from the left side and rear of assembled components of a partially assembled, presently preferred embodiment of the wheeled, manually movable, internal combustion engine powered electric generator of the present invention.

In addition to the frame 20, the engine 40, the stator and rotor, the wheeled, manually movable, internal combustion engine powered electric generator 30 comprises a first wheel assembly 11 and a second wheel assembly 31. In a desirable aspect of embodiments of the present invention, and as shown in FIG. 11J for example, the frame 20 and each of the wheel assemblies 11, 31 are configured so that the first wheel assembly 11 is pivotally connected to the first side of the frame 20 and the second wheel assembly 31 is pivotally connected to the second side of the frame 20. Moreover, the frame 20 and each of the wheel assemblies 11, 31 are configured so that each of the wheel assemblies 11, 31 is quickly and easily disassembled from the frame 20 for ease of shipment and storage and quickly and easily re-assembled to the frame 20 once arriving on site for operation.

Figure 11C:
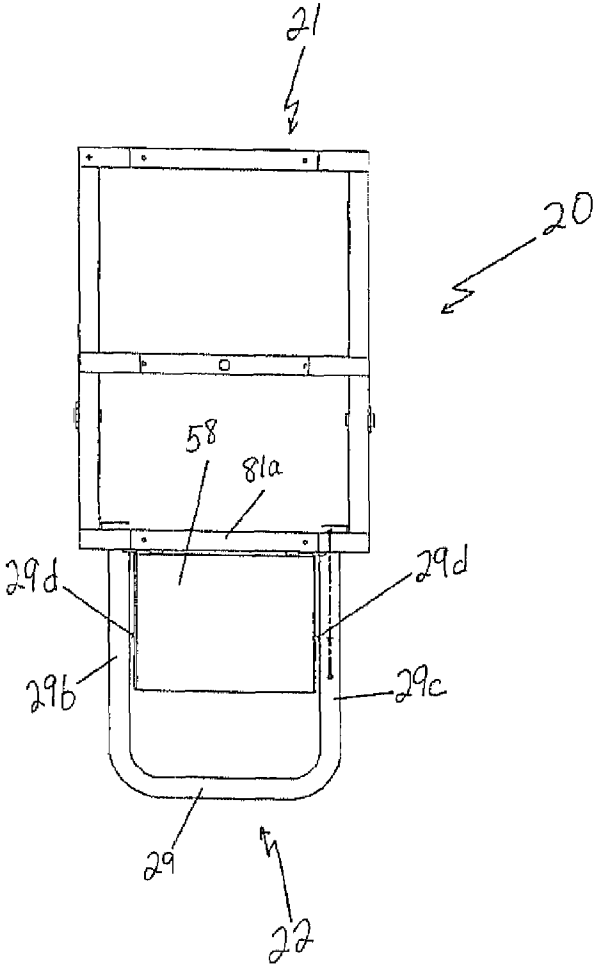
FIG. 11C is a top plan view of from above a frame component of a presently preferred embodiment of the wheeled, manually movable, internal combustion engine powered electric generator of the present invention.
Figure 11D:
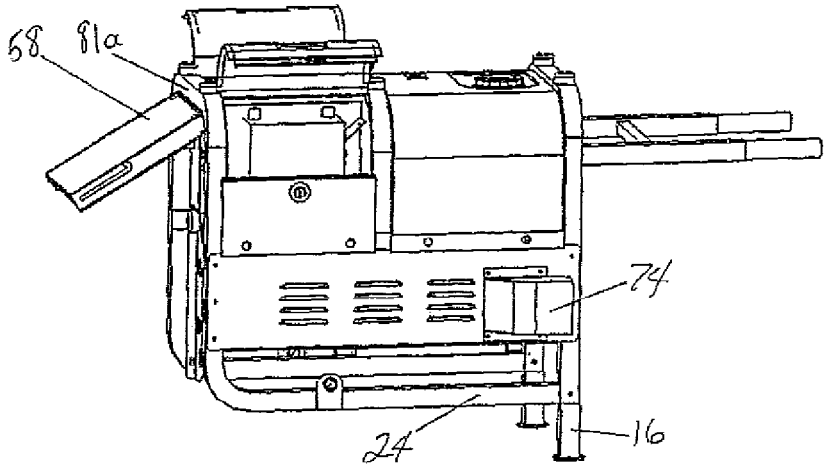
FIG. 11D is an elevated perspective view of from the left side of assembled components of a partially assembled, presently preferred embodiment of the wheeled, manually movable, internal combustion engine powered electric generator of the present invention.
Figure 11E:
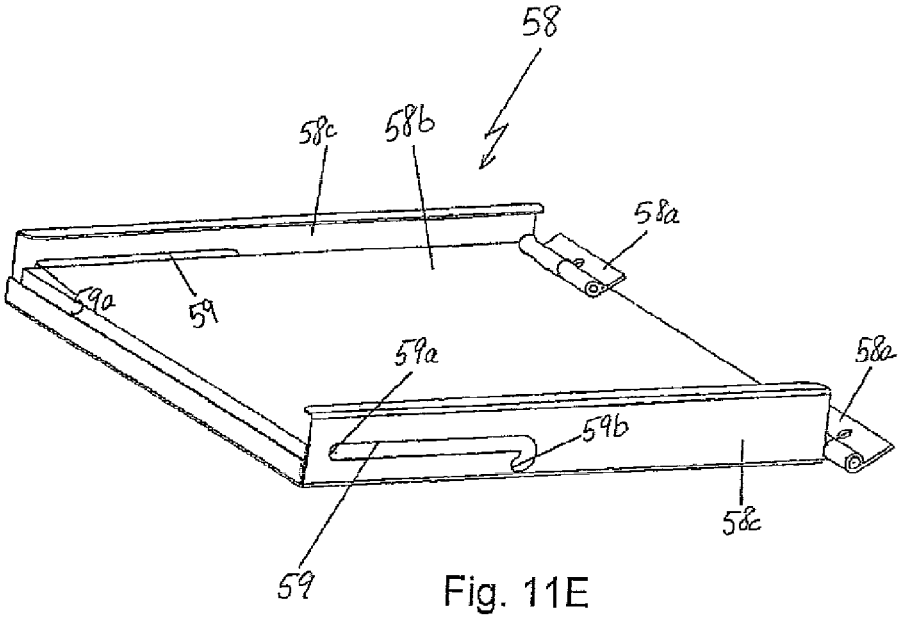
FIG. 11E is an elevated perspective view of a front panel component of a presently preferred embodiment of the wheeled, manually movable, internal combustion engine powered electric generator of the present invention.
Figure 11F:
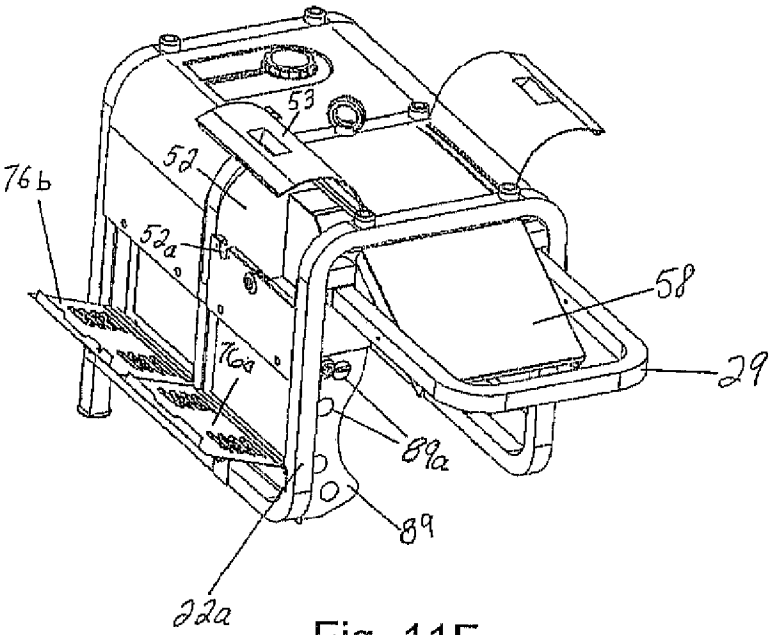
FIG. 11F is an elevated perspective view of from the front and right side of assembled components of a partially assembled, presently preferred embodiment of the wheeled, manually movable, internal combustion engine powered electric generator of the present invention.
Figure 11G:
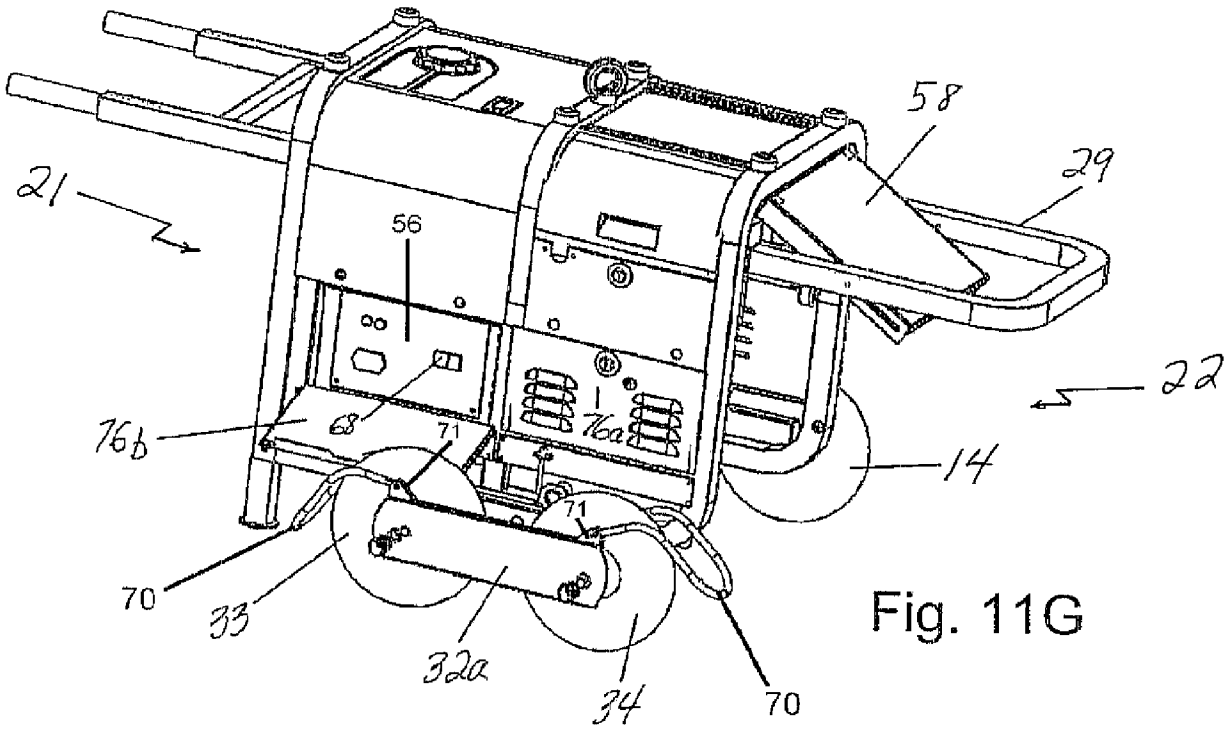
FIG. 11G is an elevated perspective view of from the right side and front of assembled components of a partially assembled, presently preferred embodiment of the wheeled, manually movable, internal combustion engine powered electric generator of the present invention.
Figure 11H:
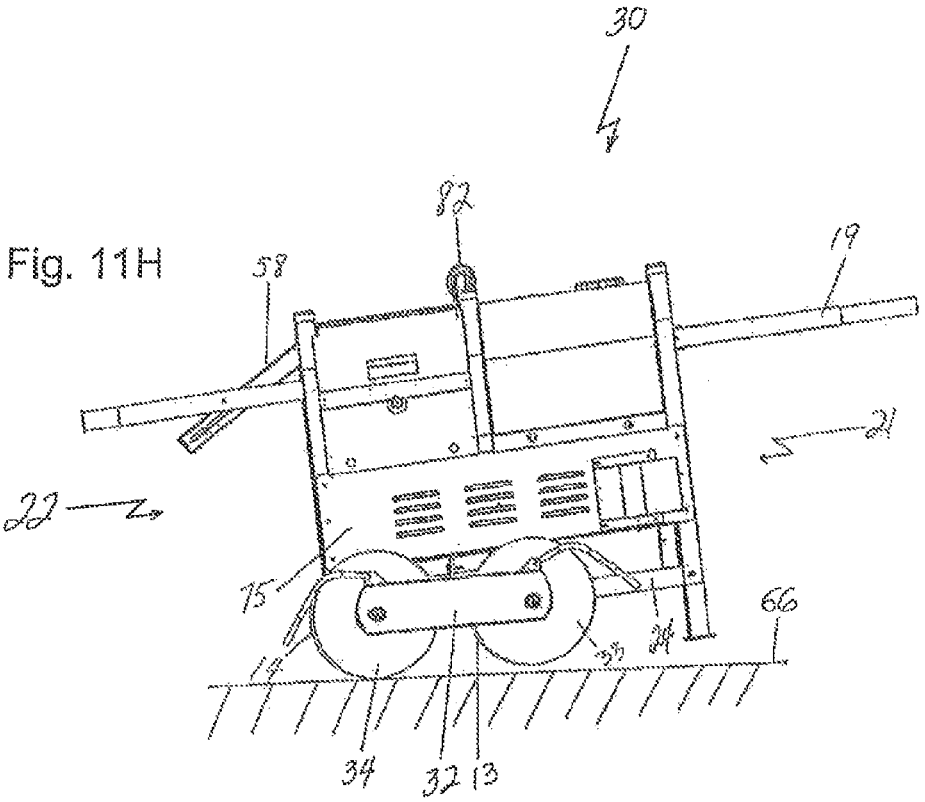
FIG. 11H is a plan view of from the left side of a presently preferred embodiment of the wheeled, manually movable, internal combustion engine powered electric generator of the present invention in a tilted position to pivot on the set of front wheels.
Figure 11I:
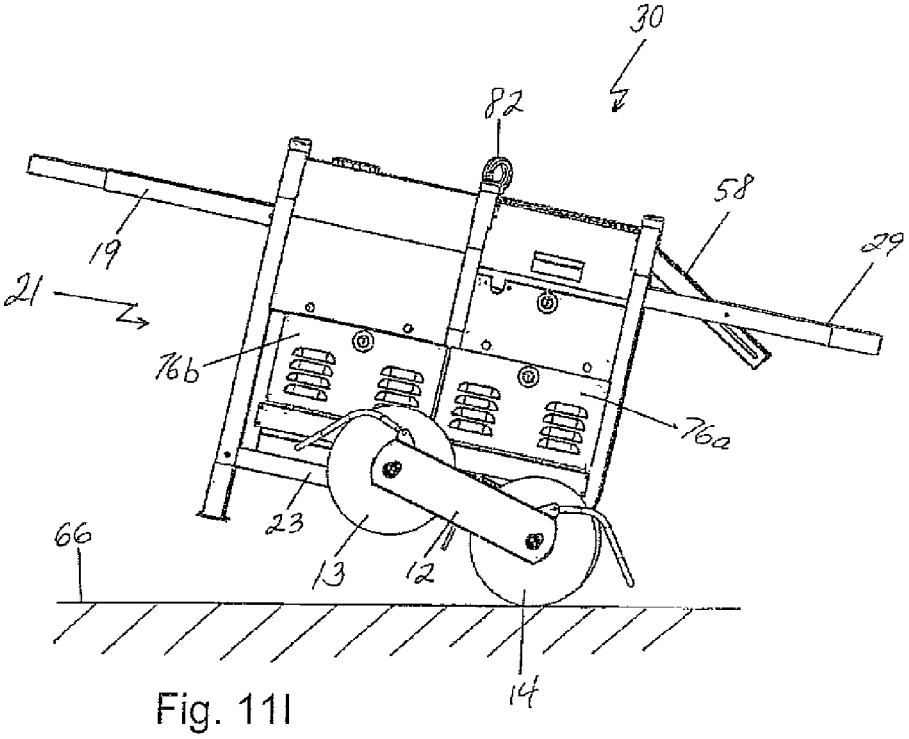
FIG. 11I is a plan view of from the right side of a presently preferred embodiment of the wheeled, manually movable, internal combustion engine powered electric generator of the present invention in a tilted position to pivot on the set of front wheels.
Figure 11J:
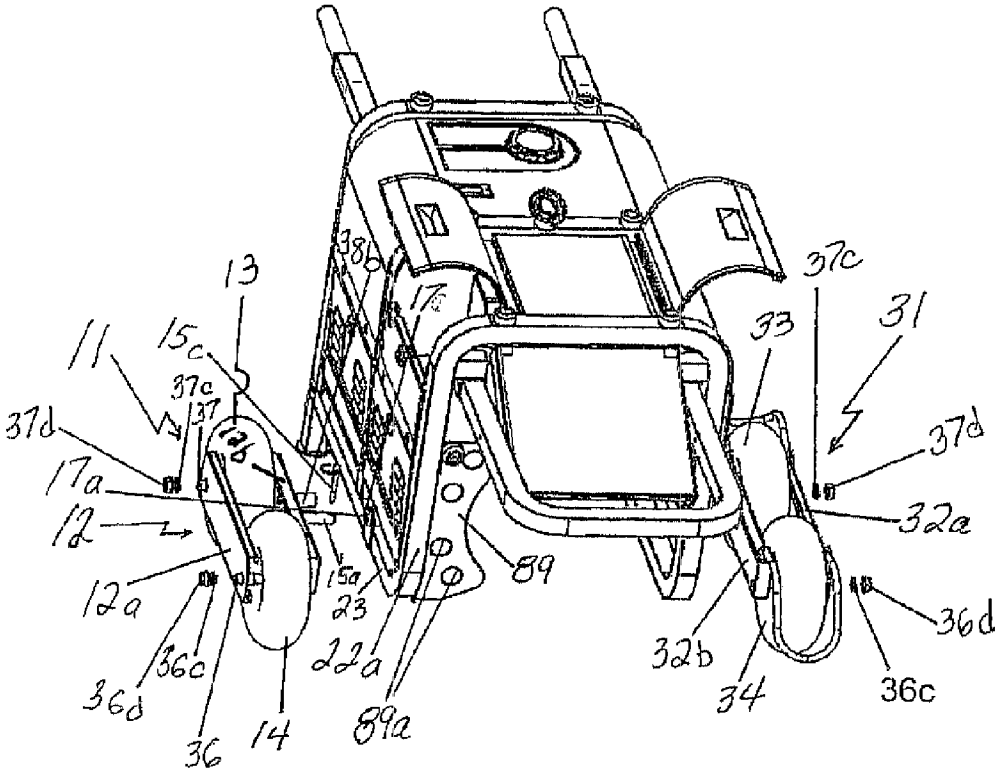
FIG. 11J is an elevated perspective view of from the front and right side of assembled components of a partially assembled, presently preferred embodiment of the wheeled, manually movable, internal combustion engine powered electric generator of the present invention.
Figure 11K:
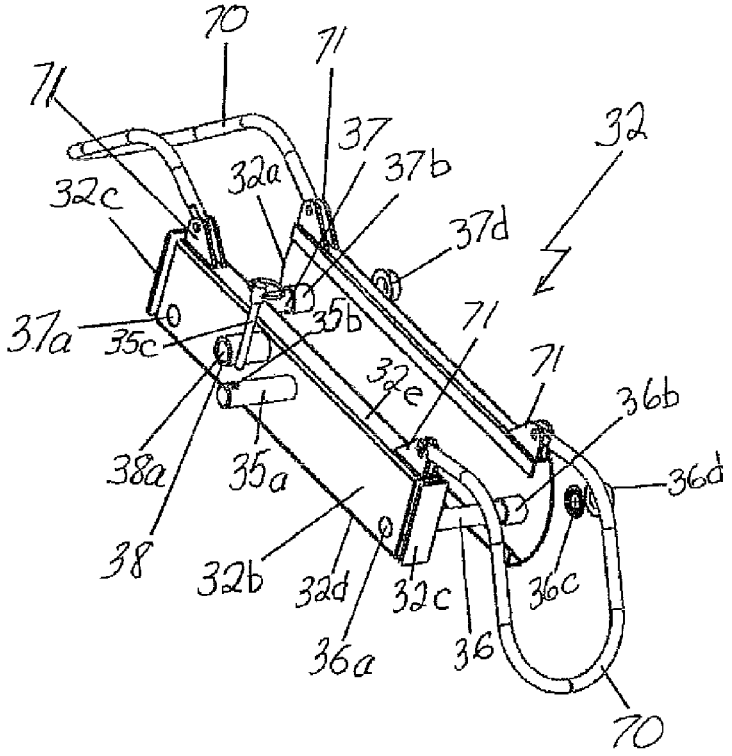
FIG. 11K is an elevated perspective view of a wheel support component of a presently preferred embodiment of the wheeled, manually movable, internal combustion engine powered electric generator of the present invention.
Figure 11L:
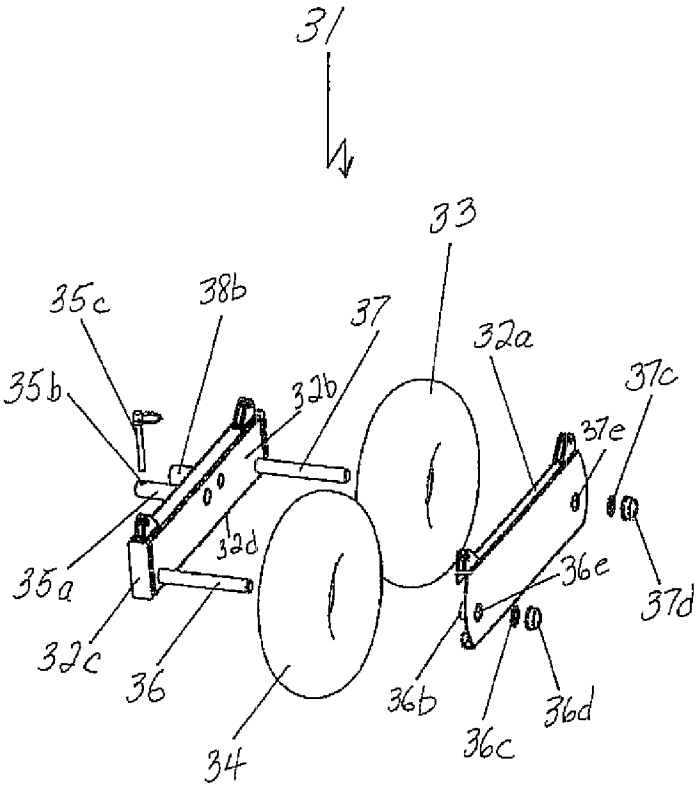
FIG. 11L is an elevated perspective view of an assemblage of components of an embodiment of a wheel assembly of a presently preferred embodiment of the wheeled, manually movable, internal combustion engine powered electric generator of the present invention.

FIG. 11K illustrates an elevated perspective view of a presently preferred embodiment of a left wheel support 32 before the wheels 33, 34 are attached and before the left wheel support 32 is pivotally attached to a presently preferred embodiment of the lower left rail 24 of the frame 20. FIG. 11L illustrates an elevated perspective view of the disassembled components of a presently preferred embodiment of a left wheel assembly 31 before the wheels 33, 34 are attached and before the outer left wheel support 32*a* is attached to the inner left wheel support 32*b* and before the inner left wheel support 32*b* is pivotally attached and selectively detachably attached, to the lower left rail 24 of the frame 20.

As shown in FIGS. 11K and 11L for example, the left wheel support 32 desirably includes an outer left wheel support 32*a* and an inner left wheel support 32*b* that is opposed to and spaced apart from the outer left wheel support 32*a*. Each of the outer left wheel support 32*a* and the inner left wheel support 32*b* desirably can be formed by a length of rectangular cross-section extrusion of 18 gauge cold rolled, tubular steel having about a 60,000 psi rating. The inner wheel support plate 32*b* defines an outer side and an inner side disposed opposite the outer side. As shown in FIG. 11K for example, in a presently preferred embodiment, the inner left wheel support 32*b* has a height of about 3 inches measured between the lower edge 32*d* and the upper edge 32*e*, a length of about 14 inches between the opposite ends, and a thickness or depth of about one inch measured between the outer side and the inner side. Each opposite end of the inner left wheel support 32*b* desirably can be sealed by an end cap 32*c* that is press fit onto the open end of the tubular extrusion that desirably forms the inner left wheel support 32*b*, and the end cap 32*c* desirably is formed of plastic or rubber. Similar end caps 32*c* can be applied to the outer left wheel support 32*a* if desired.

The left wheel support 32 desirably is pivotally mounted to the lower left side of the frame 20. As shown in FIGS. 11K and 11L for example, a left wheel assembly journal 35*a* can be mounted permanently (as by welding for example) to the inner side of the inner left wheel support 32*b* and extending axially in a direction transversely from the plane that defines the inner side of the inner left wheel support 32*b*. The inner side of the inner left wheel support 32*b* is the side that will be disposed closer to the frame 20 when the left wheel assembly 31 is pivotally connected to the frame. In a presently preferred embodiment, the central axis of rotation of the left wheel assembly journal 35*a* is disposed about two inches above the lower edge 32*d* of the inner left wheel support 32*b* and is disposed equidistantly from each of the opposed ends of the inner left wheel support 32*b*.

As shown in FIGS. 11K and 11L for example, one end 36*a* of a front wheel axle 36 can be permanently attached (as by welding for example) to the outer side of the inner left wheel support 32*b*, and one end 37*a* of a rear wheel axle 37 can be spaced apart from the front wheel axle 36 and permanently attached (as by welding for example) to the outer side of the inner left wheel support 32*b*. As shown in FIGS. 11K and 11L for example, the outer left wheel support 32*a* can include a front axle sleeve 36*b* that is configured to receive the free end of the front axle 36 therethrough, and the free end of the front axle 36 continues through an opening 36*e* defined through the outer left wheel support 32*a*. Similarly, the outer left wheel support 32*a* can include a rear axle sleeve 37*b* that is configured to receive the free end of the rear axle 37 therethrough, and the free end of the rear axle 37 continues through an opening 37*e* defined through the outer left wheel support 32*a*.

Figure 11M:
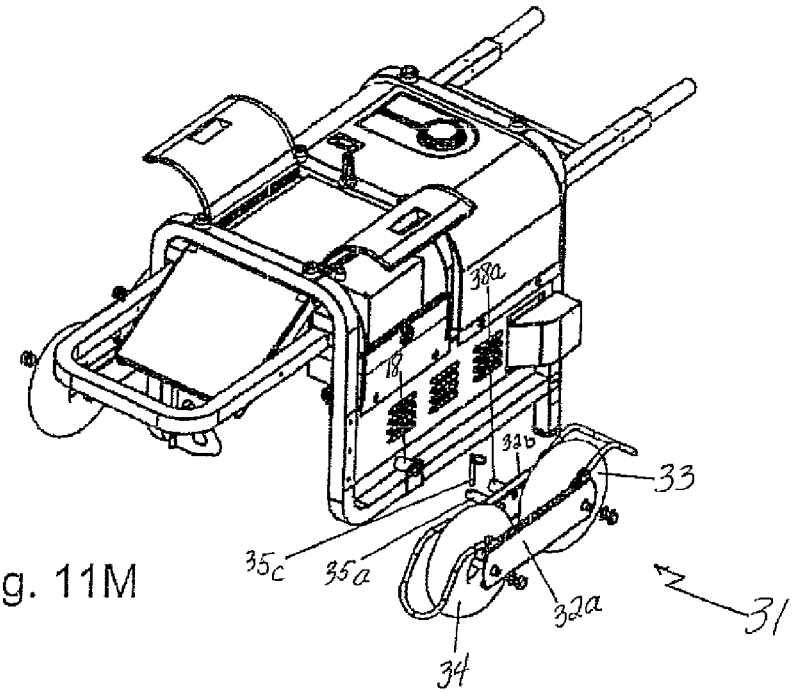
FIG. 11M is an elevated perspective view of from the front and left side of assembled components of a partially assembled, presently preferred embodiment of the wheeled, manually movable, internal combustion engine powered electric generator of the present invention.

As shown in FIGS. 11J and 11M for example, the two left wheels 34, 33 include a front left wheel 34 and a rear left wheel 33 that are rotatably disposed between the outer left wheel support 32*a* and the inner left wheel support 32*b*. In a presently preferred embodiment, each wheel 33, 34 desirably is formed of solid rubber, has a diameter of about 10 inches and a tread surface width of about 3.5 inches. The front left wheel 34 is rotatably disposed on the front wheel axle 36, and the rear left wheel 33 is rotatably disposed on the rear wheel axle 37.

In a presently preferred embodiment, the diameter of the left wheel assembly journal 35*a* and the right wheel assembly journal 15*a* desirably is about three-quarters of an inch, and the diameter of each of the front axle 36 and rear axle 37 desirably is about five-eighths of an inch. As shown in FIGS. 11K and 11L for example, the axis of rotation of the left wheel assembly journal 35*a* desirably is disposed equidistant from each of the axes of rotation of the front and rear axles 36, 37, which desirably are spaced apart at their central axes by about 12.625 inches in a presently preferred embodiment. In a presently preferred embodiment, the central axis of rotation of each of the front wheel axle 36 and rear wheel axle 37 desirably is disposed about three quarters of an inch above the lower edge 32*d* of the inner left wheel support 32*b* and desirably is disposed equidistantly from each of the opposed ends of the inner left wheel support 32*b*.

As shown in FIGS. 11K and 11L for example, while the axes of rotation of the front and rear axles 36, 37 desirably are disposed closer to the lower edge 32*d* of the inner left wheel support 32*b*, the axis of rotation of the left wheel assembly journal 35*a* desirably is disposed closer to the upper edge 32*e* of the inner left wheel support 32*b*. In a presently preferred embodiment, the vertical distance between the central axis of rotation of the left wheel assembly journal 35*a* and the central axis of rotation of each of the front and rear axles 36, 37 desirably is about 1.25 inches. Thus, the center points of the axis of rotation of the left wheel assembly journal 35*a* and the axes of rotation of the front and rear axles 36, 37 desirably form the vertices of an isosceles triangle drawn in the plane of the inner left wheel support 32*b*.

Referring to FIGS. 11K and 11L for example, to assemble the left wheel assembly 31 for example, the front wheel axle 36 is passed through the front wheel bearing of the front wheel 34 and through the front axle sleeve 36*b* and the aligned concentric opening 36*e* in the outer left wheel support 32*a*, and the free end of the front axle 36 is secured by a fastener 36*c*, which desirably can be a washer that is press-fit onto the free end of the front axle 36. The free end of the front wheel axle 36 can be covered with a cap 36*d*. The same procedure can be followed for the rear wheel 33, the rear wheel axle 37, the rear axle sleeve 37*b* in the outer left wheel support 32*a*, the fastener 37*c* for the free end of the rear axle 36, and a cap 37*d*. When the components of the left wheel assembly 31 in FIG. 11L are full assembled, a presently preferred embodiment of left wheel assembly 31 desirably weighs about 22 pounds. The addition of the wheel locks 70 (described more fully below) would add less than an additional pound to the weight of the left wheel assembly 31.

When the left wheel assembly 31 is so assembled, the axes of rotation of the front and rear axles 36, 37 are perpendicular to the parallel planes that define the outer left wheel support 32*a* and the inner left wheel support 32*b* and parallel to the axis of rotation of the left wheel assembly journal 35*a*. As shown in FIG. 1 for example, left front wheel 34 of the left wheel assembly 31 desirably is spaced apart in the axial direction of the frame from the left rear wheel 33 of the left wheel assembly 31. Moreover, as shown in FIG. 11J for example, the front left wheel 34 and the rear left wheel 33 desirably are aligned with each other such that the central circumferential line (the equator if you will) of each wheel falls in generally the same plane.

Figure 2:
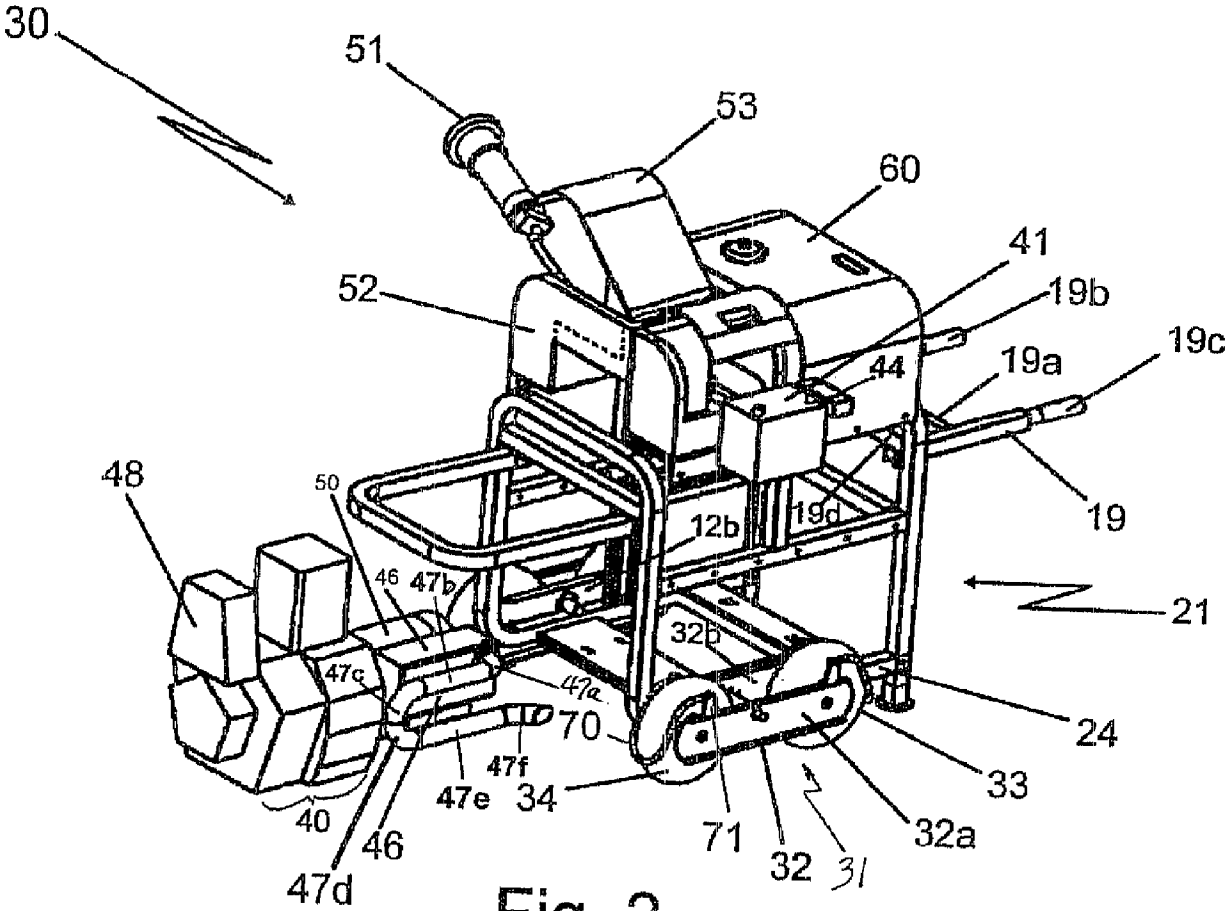
FIG. 2 is an elevated perspective view of the front and left side of assembled components of a partially assembled, preferred embodiment of the wheeled, manually movable, internal combustion engine powered electric generator of the present invention.
Figure 3:
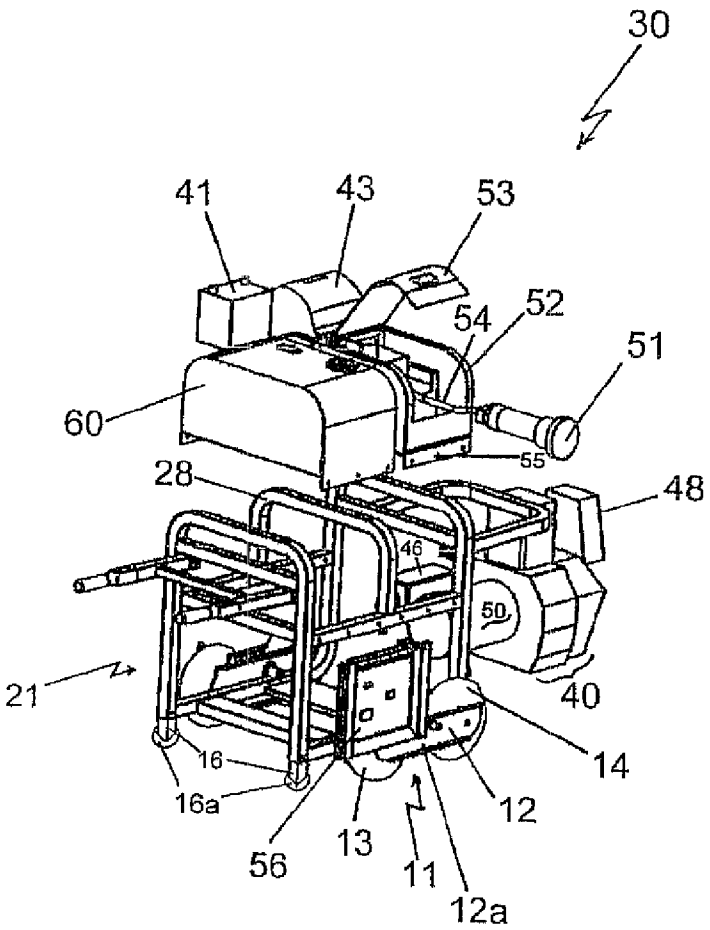
FIG. 3 is an elevated perspective view of the rear and right side of assembled components of a partially assembled, preferred embodiment of the wheeled, manually movable, internal combustion engine powered electric generator of the present invention.

The right wheel assembly 11 is a mirror image of the left wheel assembly 31. As shown in FIGS. 3 and 11J for example, a right wheel assembly 11 can include a right wheel support 12 and two right wheels 13, 14 rotatably mounted to the right wheel support 12. The right wheel support 12 desirably includes an outer right wheel support 12*a* (FIGS. 3 and 11J) and an inner right wheel support 12*b* (FIG. 2) that is opposed to and spaced apart from the outer right wheel support 12*a* and that defines an outer side and an inner side disposed opposite the outer side. A front wheel axle extends transversely from the outer side of the right inner wheel support plate 12*b*, and the right wheel assembly 11 includes a rear wheel axle extending transversely from the outer side of the right inner wheel support plate 12*b* and spaced apart from the front wheel axle. The two right wheels disposed between the outer right wheel support 12*a* (FIG. 3) and the inner right wheel support 12*b* (FIG. 2) include a rear right wheel 13 (FIG. 3) rotatably disposed on the rear wheel axle and a front right wheel 14 (FIG. 3) rotatably disposed on the front wheel axle. As shown in FIG. 11J for example, the rear right wheel 13 and the front right wheel 14 desirably are aligned with each other such that the axis of rotation of each wheel is spaced apart from and parallel to the axis of rotation of the other wheel in the right wheel assembly 11.

The right wheel assembly 11 desirably is pivotally mounted and selectively detachably connected to the lower right side of the frame 20. As shown in FIG. 11J for example, the right wheel assembly 11 includes a right wheel assembly journal 15*a* extending axially from the inner side of the right inner wheel support plate 12*b* and extending in a transverse direction parallel to the front wheel axle 36 and the rear wheel axle 37. The inner side of the inner right wheel support 12*b* is the side that will be disposed closer to the frame 20 when the right wheel assembly 11 is pivotally connected to the frame. The right wheel assembly journal 15*a* is pivotally connected to the right side of the frame.

As shown in FIG. 11A for example, a left wheel bearing 18 is formed by a hollow section of a stainless steel tube that is rigidly and permanently mounted (as by welding for example) to left bottom rail 24 at the lower portion of the left side of the frame 20. The left wheel assembly journal 35*a* of the left wheel support 32 desirably is configured to rotate within the opening 18*a* (see e.g., FIGS. 11A, 11B) that is defined through the left wheel bearing 18, and accordingly the left wheel assembly 31 is pivotally connected to the left side of the frame. Referring to FIGS. 11A, 11B for example, the linear horizontal distance between the central rotational axis of the opening 18*a* through the left wheel bearing 18 and the farthest surface of the left vertical rear leg 21*b* of the frame 20 desirably is about 19.5 inches in a presently preferred embodiment. In such an embodiment, the horizontal length from the forwardmost edge of the left front vertical leg 22*b* and the central rotational axis of the opening 18*a* through the left wheel bearing 18 desirably measures about 9.375 inches long.

As similarly shown in FIG. 11A for example, a right wheel bearing 17 is formed by a hollow section of a stainless steel tube that is rigidly and permanently mounted (as by welding for example) to right bottom rail 23 at the lower portion of the right side of the frame 20. The right wheel assembly journal 15*a* of the right wheel support 12 desirably is configured to rotate within the opening 17*a* (see e.g., FIGS. 11A and 11J) that is defined through the right wheel bearing 17, and accordingly the right wheel assembly 11 is pivotally connected to the right side of the frame. The same dimension of about 19.5 inches desirably also pertains to the linear horizontal distance between the central rotational axis of the opening 17*a* through the right wheel bearing 17 and the farthest surface of the right vertical rear leg 21*a* of the frame 20 in a presently preferred embodiment. In such an embodiment, the horizontal length from the forwardmost edge of the right front vertical leg 22*a* and the central rotational axis of the opening 17*a* through the right wheel bearing 17 desirably also measures about 9.375 inches long.

Figure 12A:
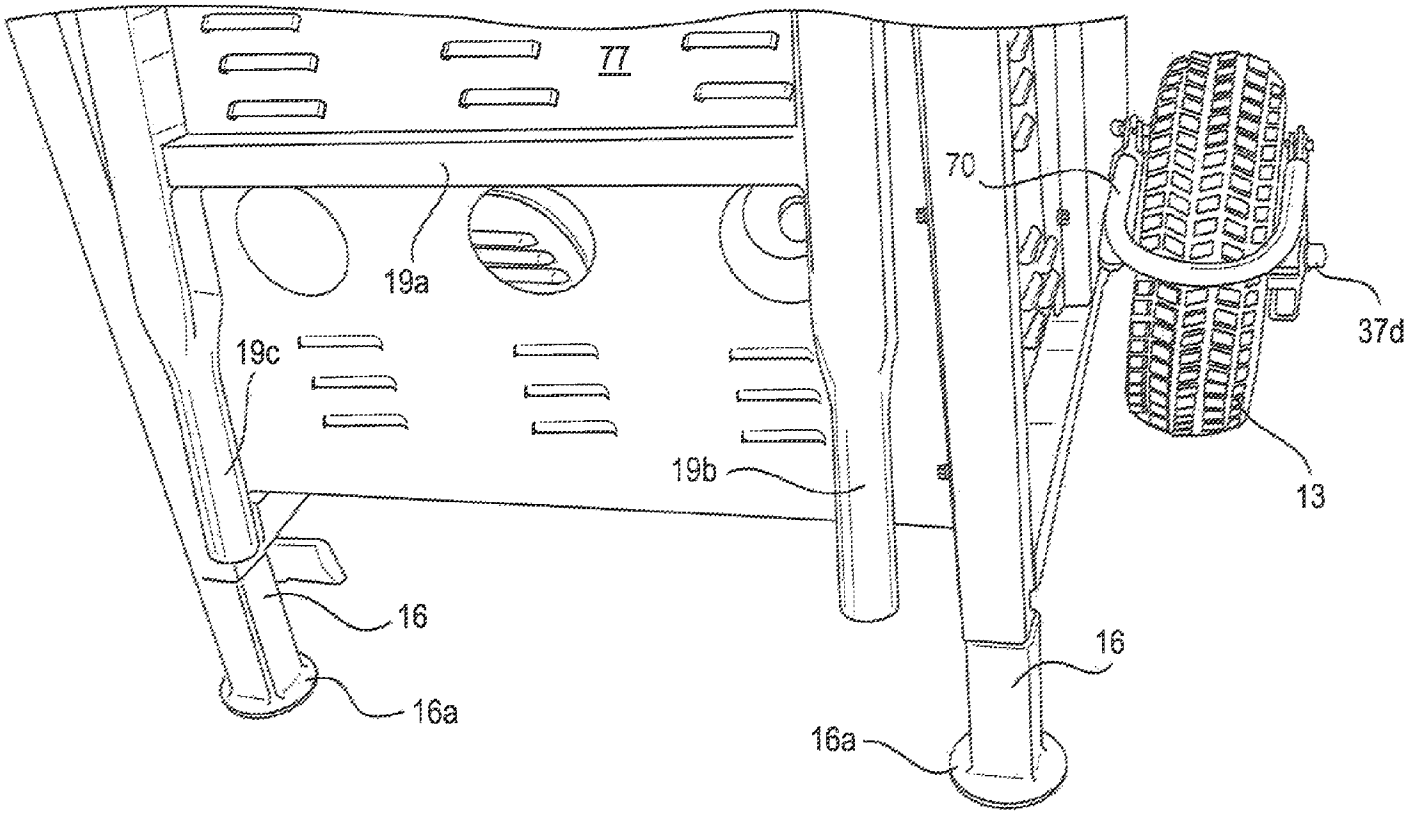
FIG. 12A is a plan view from the rear of a presently preferred embodiment of the wheeled, manually movable, internal combustion engine powered electric generator of the present invention.
Figure 12B:
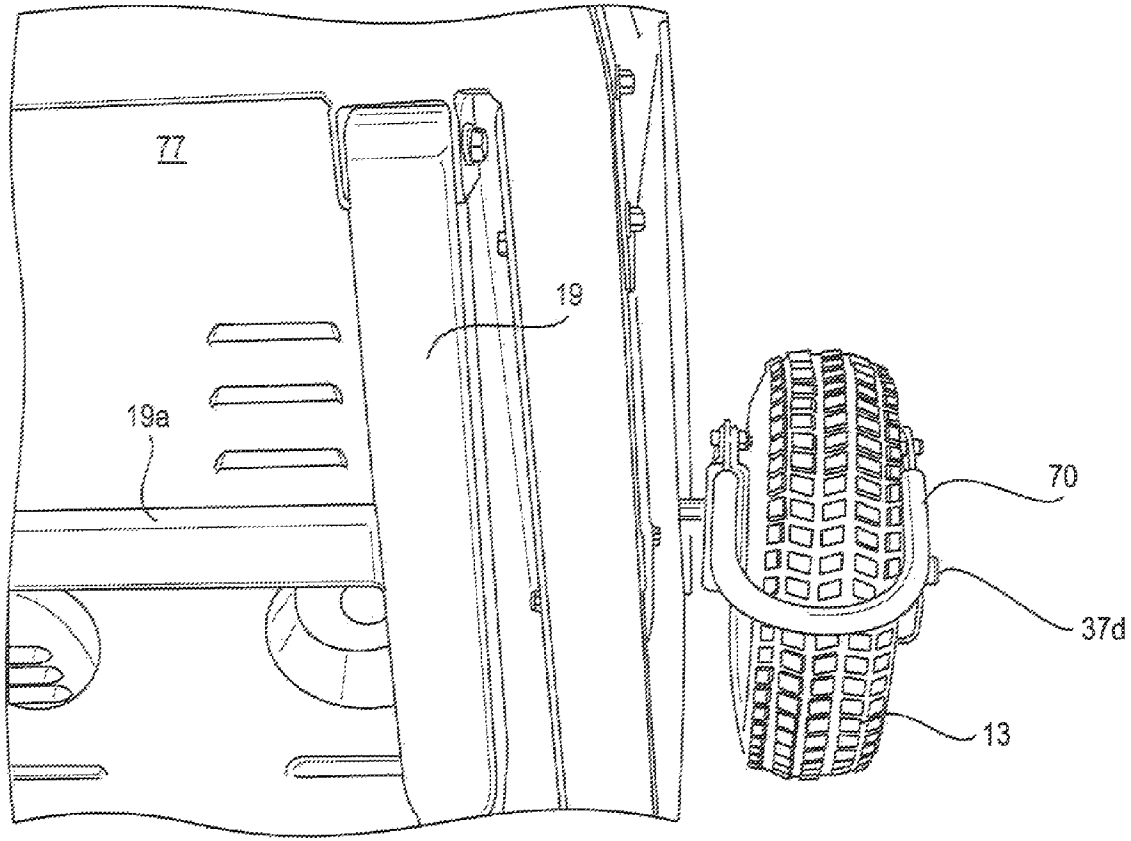
FIG. 12B is a perspective view from the rear of a presently preferred embodiment of the wheeled, manually movable, internal combustion engine powered electric generator of the present invention.
Figure 12C:
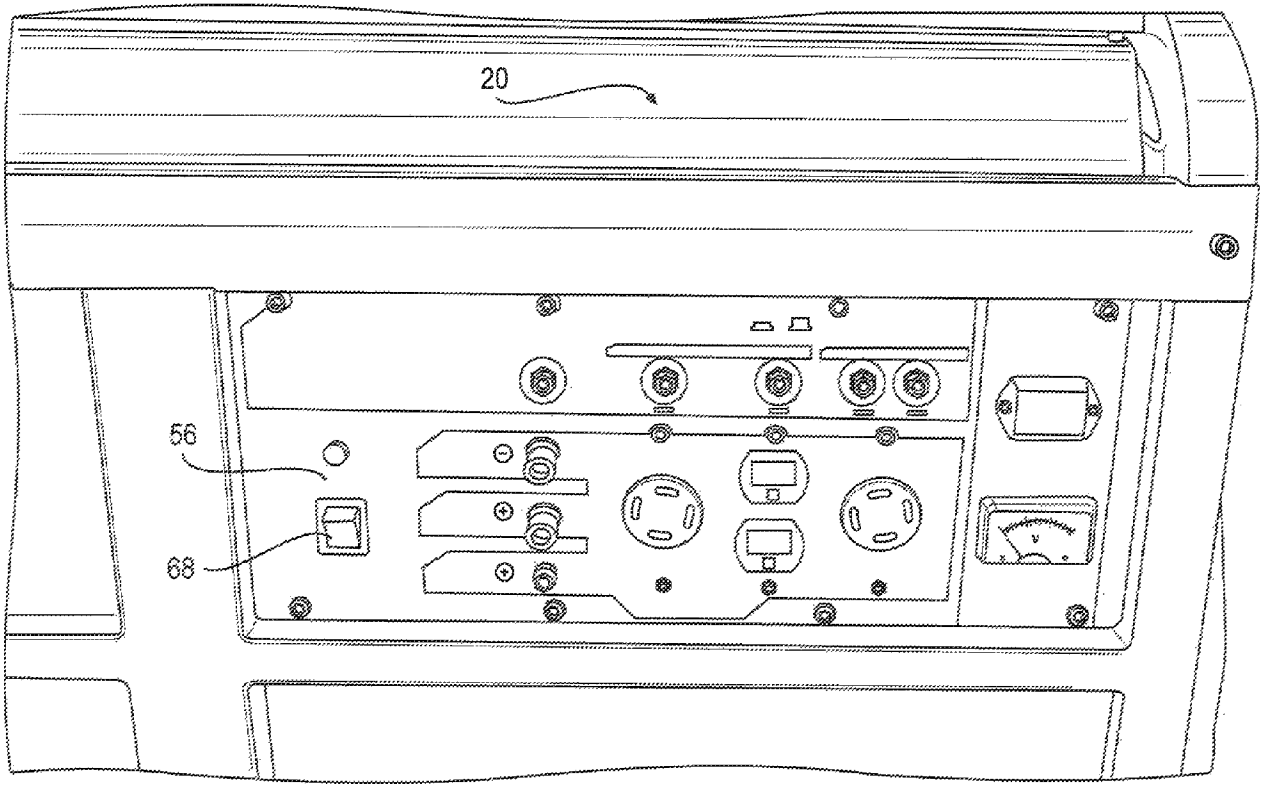
FIG. 12C is an elevated perspective view of assembled components of a presently preferred embodiment of the wheeled, manually movable, internal combustion engine powered electric generator of the present invention.

Each of the respective right and left wheel assembly 11, 31 desirably includes a respective quick-disconnect member 15*c*, 35*c* that is configured to selectively permit quickly disconnecting that wheel assembly from that side of the frame. As shown in FIGS. 11K and 11L, a hole 35*b* is defined through the left wheel assembly journal 35*a* near the free end thereof, and the hole 35*b* is configured to receive therein a cotter pin 35*c*. After the left wheel assembly journal 35*a* of the left wheel support 32 is inserted through the opening 18*a* in the left wheel bearing 18, a cotter pin 35*c* desirably is inserted through the hole 35*b* to complete the rotational and pivoting attachment of the left wheel support 32 of the left wheel assembly 31 to the lower left rail 24 of the frame 20. As shown in FIGS. 11J and 12G for example, a cotter pin 15*c* similarly is used to complete the rotational and pivoting attachment of the right wheel assembly journal 15*a* of the right wheel support 12 of the right wheel assembly 11 to the right bottom rail 23 of the frame 20. In this way, the user's selective removal or insertion of the cotter pin 15*c* or 35*c* provides for quick removal or assembly, respectively, of the respective wheel assembly from and to the frame 20 for ease of shipping and on-site re-assembly.

As shown in FIG. 11A for example, the respective right bearing 17 that rotatably receives the right wheel assembly journal 15*a* (e.g., FIG. 11J) of the right wheel assembly 11 and left bearing 18 that rotatably receives and supports the left wheel assembly journal 35*a* (e.g., FIG. 11K) of the left wheel assembly 31 will be disposed between the front end 22 of the frame 20 and the center of gravity of the overall unit 30, whether the generator's fuel tank 60 is full of fuel or empty. With these locations of the right and left journal bearings 17, 18, each of the right wheel assembly 11 and left wheel assembly 31 will become pivotally mounted to the frame 20 such that the pivot points at the centers of the axes of rotation of the respective journals 15*a*, 35*a* facilitate maneuvering over rough terrain with a full tank of fuel without fear of the generator 30 tipping over the front wheels 14, 34. Moreover, each of the right wheel assembly 11 and left wheel assembly 31 desirably pivots independently of the other wheel assembly. Thus, each of the right wheel assembly 11 and left wheel assembly 31 can negotiate over relatively raised obstructions or through depressions in the path independently of each other.

Each of the respective right and left wheel assembly 11, 31 desirably includes a respective pivot pin that extends from the inner side of the respective inner wheel support plate 12*b*, 32*b* of that wheel assembly and configured and disposed to contact the respective upper surface 23*a*, 24*a* of the bottom rail 23, 24 when the rear support feet 16 are lifted off the ground by a predetermined distance. That predetermined distance can be set based on the anticipated obstacles likely to be presented by the terrain where the generator is intended to be deployed. Additionally, each respective pivot pin desirably is disposed closer to the respective rear wheel axle 37 of the respective wheel assembly 11, 31 than to the front wheel axle 36 of the respective wheel assembly.

As shown in FIG. 11K, a short length of cylindrical steel tubing can be disposed as a left side pivot pin 38*a* having one opposite end mounted (as by welding for example) to the inner left wheel support 32*b* and extending axially from the inner side thereof in the same direction as and parallel to the left wheel assembly journal 35*a*. The left side pivot pin 38*a* has a diameter of about one half inch and is surrounded by an annular rubber sleeve 38 such that the combined diameter of the left side pivot pin 38*a* and sleeve 38 is about three-quarters of an inch to about one inch.

Figure 12D:
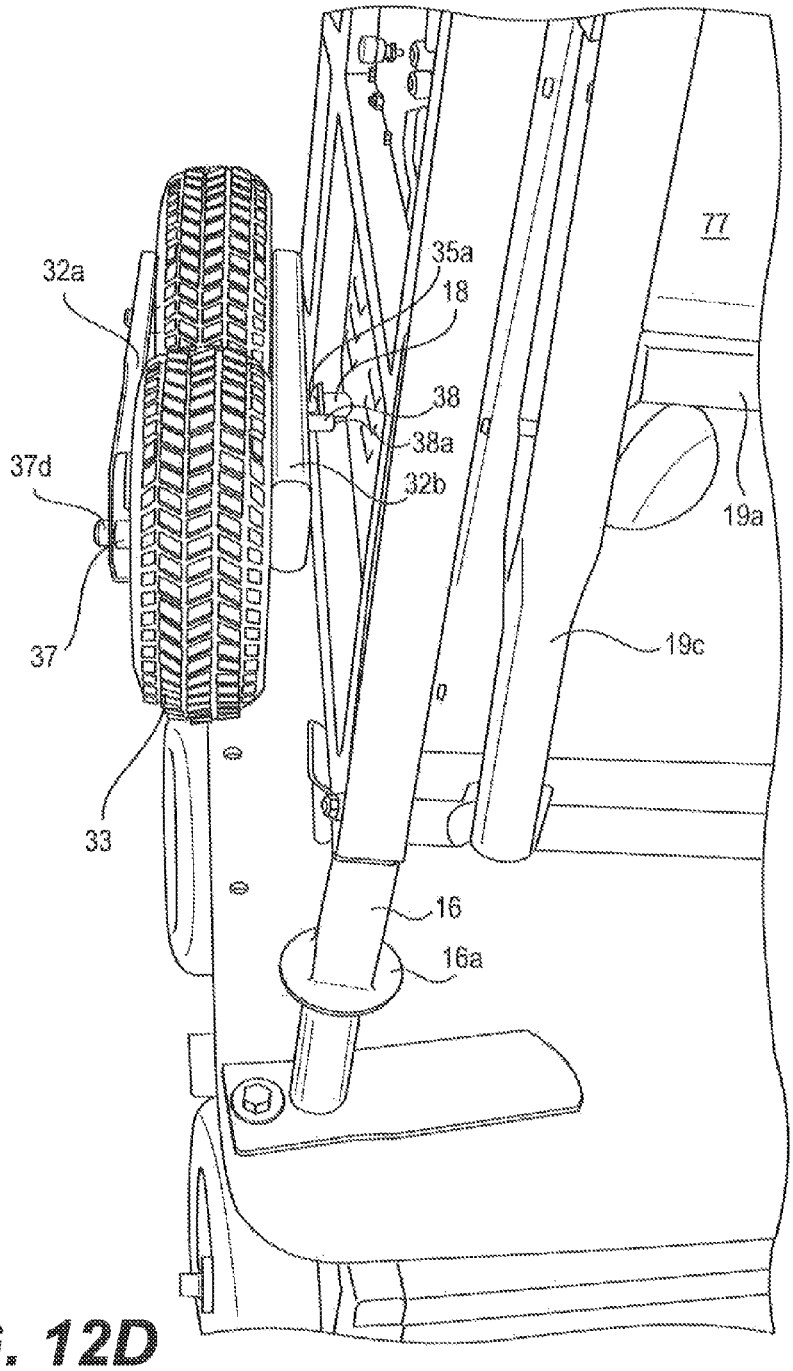
FIG. 12D is another perspective view from the rear and left side of part of a presently preferred embodiment of the wheeled, manually movable, internal combustion engine powered electric generator of the present invention.
Figure 12E:
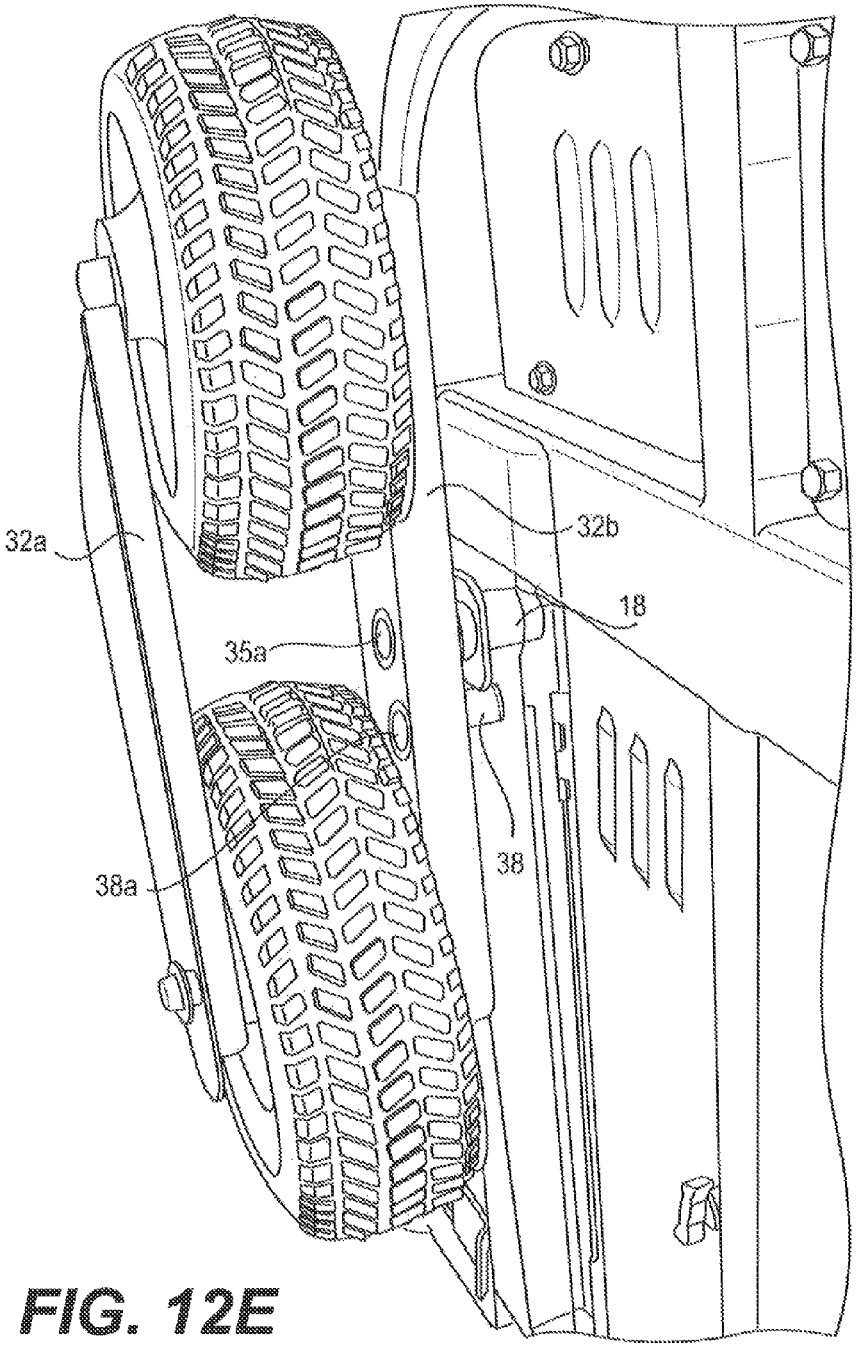
FIG. 12E is another perspective view from above the left side of part of a presently preferred embodiment of the wheeled, manually movable, internal combustion engine powered electric generator of the present invention.
Figure 12F:
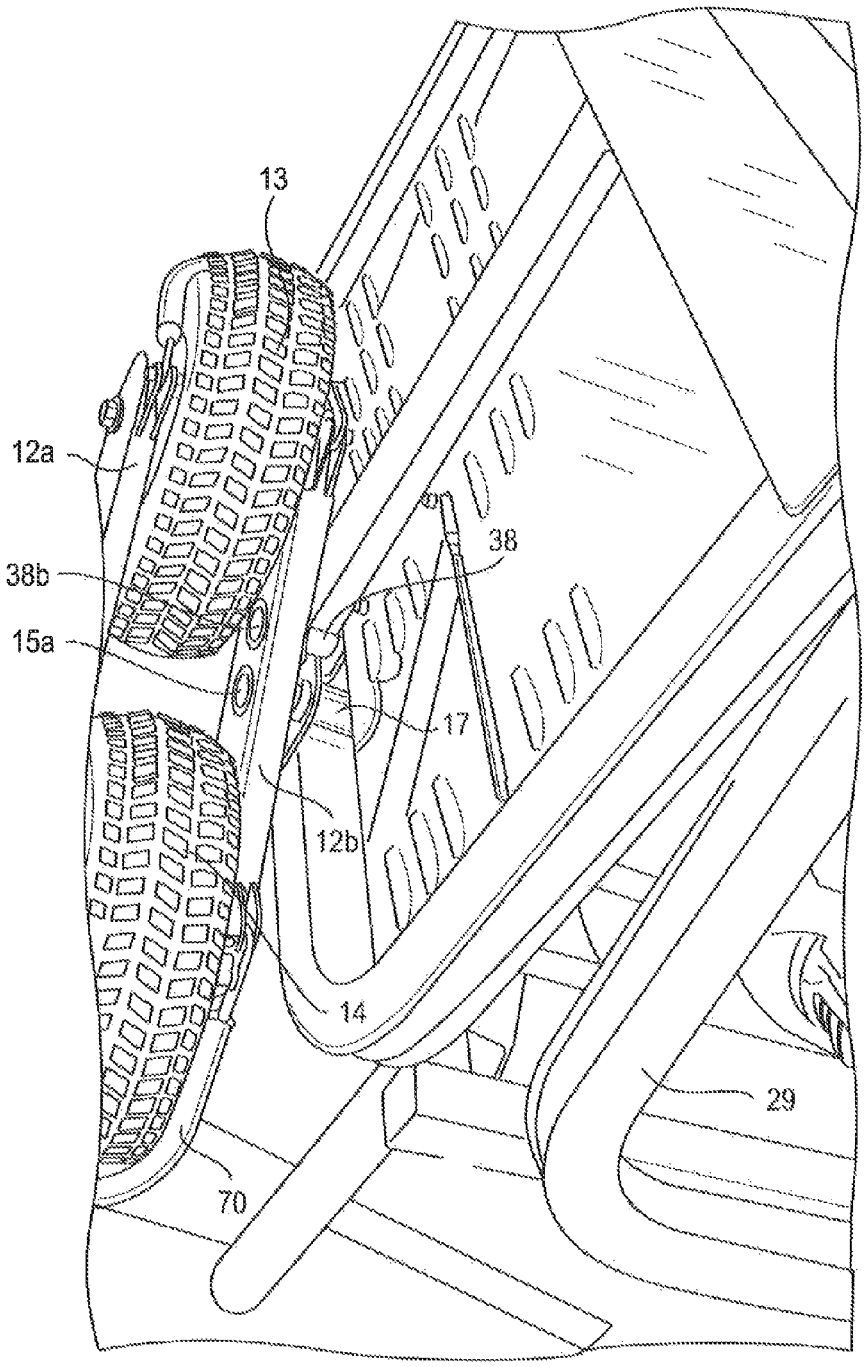
FIG. 12F is another perspective view from the front right of part of a presently preferred embodiment of the wheeled, manually movable, internal combustion engine powered electric generator of the present invention.
Figure 12G:
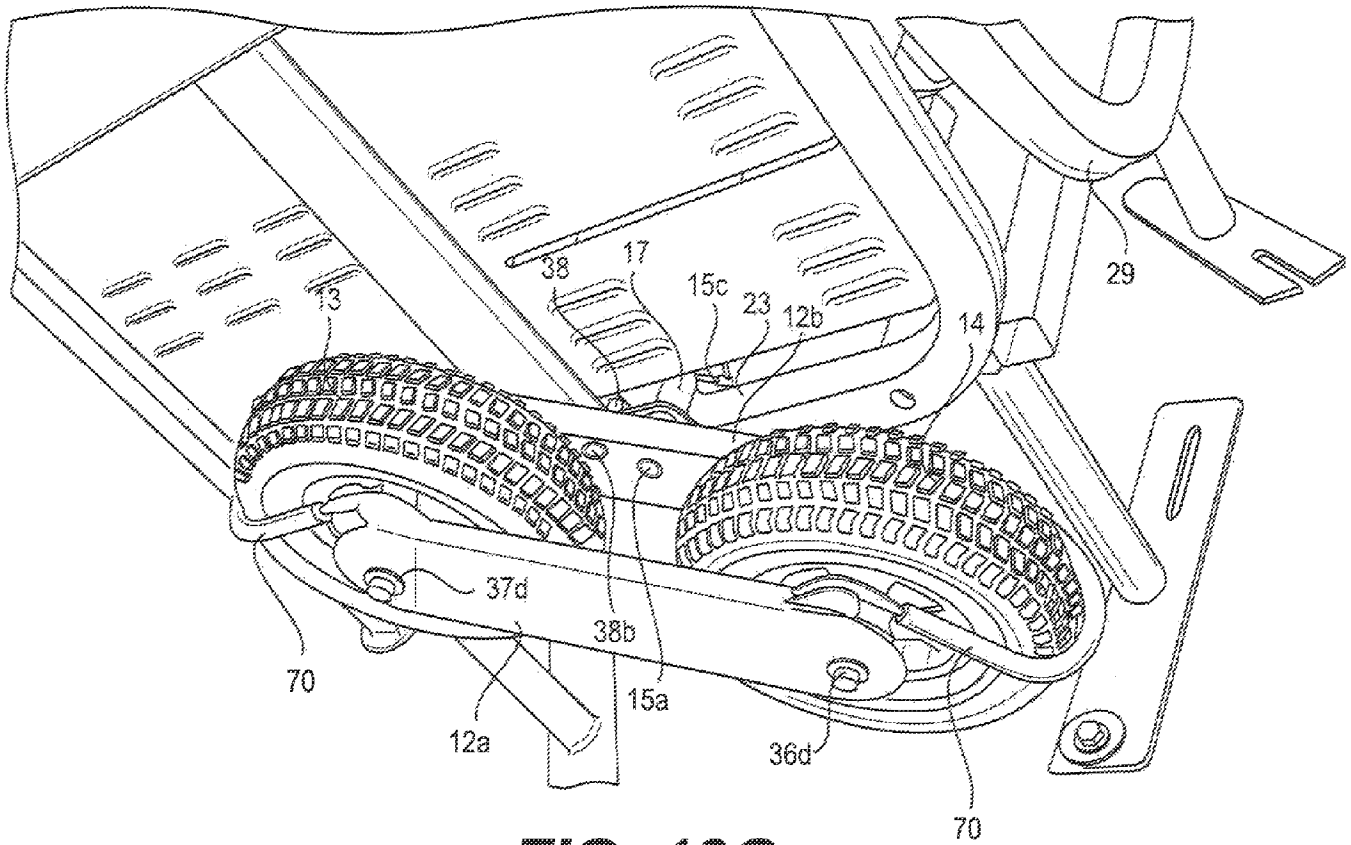
FIG. 12G is another perspective view from the right side from the front of part of a presently preferred embodiment of the wheeled, manually movable, internal combustion engine powered electric generator of the present invention.

As shown in FIGS. 11K, 12D and 12E, the left side pivot pin 38*a* is disposed between the left wheel assembly journal 35*a* and the end 37*a* of the rear wheel axle 37 that is attached to the inner left wheel support 32*b*. Moreover, as shown in FIG. 11K, the left side pivot pin 38*a* is disposed closer to the upper edge 32*e* of the inner left wheel support 32*b* than is the left wheel assembly journal 35*a*. In a presently preferred embodiment, the central axis of rotation of the left side pivot pin 38*a* is disposed about 2.375 inches above the lower edge 32*d* of the inner left wheel support 32*b* and is disposed about 5.25 inches from the closest one of the opposed ends of the inner left wheel support 32*b*. Accordingly, in a presently preferred embodiment, the vertical distance between the central axis of rotation of the left side pivot pin 38*a* and the central axis of rotation of the left wheel assembly journal 35*a* is about three eighths of an inch. Similarly, as shown in FIGS. 11J and 12F, a right side pivot pin 38*b* has one opposite end mounted (as by welding for example) to the inner side of the inner right wheel support 12*b* and extending in the same direction as and parallel to the right wheel assembly journal 15*a* and is covered by an annular rubber sleeve 38. With this relative disposition of the pivot pins 38*a*, 38*b* in relation to the respective wheel assembly journals 35*a*, 15*a* and their respective bearings 18, 17, for the journals 35*a*, 15*a*, when the generator is resting on all four wheels 34, 33, 14, 13 as in FIG. 11G for example, the lowermost surface of the annular rubber sleeve 38 covering each respective pivot pin 38*a*, 38*b* of the left wheel support 32 and the right wheel support 12 respectively, is desirably spaced vertically less than an eighth of an inch above the upper surface 24*a*, 23*a* of the corresponding bottom rail 24, 23.

Figure 11N:
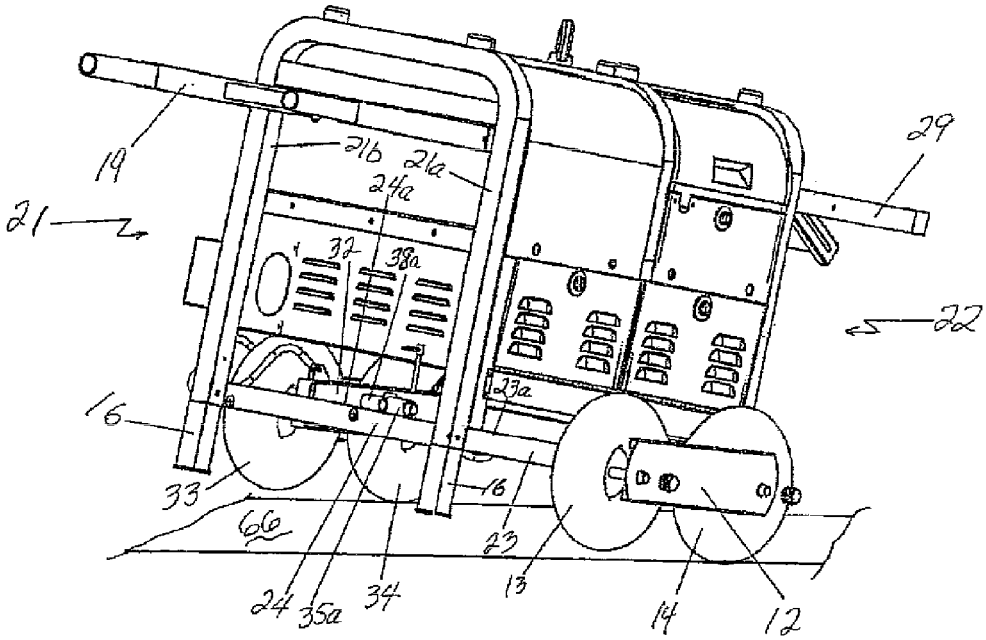
FIG. 11N is an elevated perspective view of from the rear and right side of assembled components of a partially assembled, presently preferred embodiment of the wheeled, manually movable, internal combustion engine powered electric generator of the present invention in a tilted position to pivot on the set of front wheels.

FIG. 11N for example shows a view when the generator frame's rear end 21 is lifted vertically away from the ground 66 using the rear handle 19. When this lifting movement begins to occur, each respective pivot pin 38*a*, 38*b* of the left wheel support 32 and the right wheel support 12 respectively almost immediately comes into contact with and engages the upper surface 24*a*, 23*a* of the frame's corresponding bottom rail 24, 23 so that the respective rear wheels 33, 13 become lifted away from contact with the ground 66. Thus, each respective pivot pin 38*a*, 38*b* of each respective wheel assembly 31, 11 is disposed to engage the frame and lift one end of that wheel assembly with respect to the ground when one end of the frame is lifted a predetermined distance above the ground. The upwardly tilted condition of the rear end 21 of the generator 30 is also illustrated in a left side plan view in FIG. 11H and in a right side plan view in FIG. 11I. In so doing, it becomes easier for the generator to be pivoted on just the two front end wheels 34, 14 so that the entire generator can be pivoted from side to side, left or right, on the two front end wheels 34, 14.

Moreover, emergency stand alone electric generators often must be located in remote areas, such as when deployed to provide emergency power to cell phone towers in rural areas. If the retractable rear handle 19 at the rear end 21 of the frame is being used to pull the generator over the terrain in the path of the generator's wheels 13, 14, 33, 34 when negotiating a relatively elevated section of the path (such as a curb) on the left side of the frame for example, the rear left wheel 33 can raise above the front left wheel 34 as the frame moves past the bump in the path. In so doing, it also becomes easier for the generator to be pulled from the rear end 21 on just the two front end wheels 34, 14 so that the rear wheels 33, 13 become elevated to encounter an elevated obstruction and ease the transition of the generator over an elevated obstruction in the generator's path. This feature of one aspect of an embodiment of the generator allows the generator to be deployed in relatively rougher terrain than otherwise would be possible.

In accordance with one aspect of an embodiment of the generator, a wheel locking mechanism can be provided that enables both the front and rear wheels of a wheel assembly 11 or 31 to be locked against rotation once the unit 30 is situated where desired, e.g., next to a cell tower that has batteries that would need to be recharged by the electricity generated by the generator unit 30. As shown in FIGS. 7, 8, 11G and 11K for example, a retractable, wheel lock 70 desirably can be pivotally mounted to a pair of opposed wheel lock flanges 71 that are fixed to the outer left wheel support 32*a* and inner left wheel support 32*b*, respectively. In one embodiment, a separate wheel lock 70 desirably is provided for each of the left wheels 33, 34. However, in another presently preferred alternative embodiment shown in FIGS. 12F and 12G for example, a separate wheel lock 70 desirably can be provided for each of the right wheels 13, 14. While a separate wheel lock 70 can be provided for each of the four wheels 13, 14, 33, 34, if the generator is disposed on an incline, it may be advantageous to dispose the wheel locks 70 on only the wheels of one of the wheel assemblies 11 or 31. By so doing, the side of the generator without the locked wheels will tend to arc in a circle rather than follow the pull of gravity down the incline.

As shown in FIGS. 7, 8, 11G and 11K for example, each wheel lock 70 desirably can be provided in the form of a U-shaped rod that has a closed loop portion at one end of the wheel lock 70 and at the opposite extreme of the wheel lock 70 has two free ends opposed to each other and pivotally connected to the respective wheel assembly 11 or 31. Each U-shaped rod further defines an intermediate section disposed between the free ends and the closed loop portion, and the intermediate section desirably is bent at an angle relative to the plane in which the closed loop portion of the U-shaped rod resides. When engaged as a wheel brake, the closed loop portion of the wheel lock 70 contacts a portion of the respective rolling surface of the wheel 33, 34 and prevents the respective wheel from rotating in the direction toward the closed loop portion. When both wheel locks 70 of the embodiments shown in FIGS. 7, 8, 11G and 11K are engaged to the respective wheels 33, 34, the left side of unit 30 is prevented from rolling forward or backward. When both wheel locks 70 of the embodiments shown in FIGS. 12F and 12G are engaged to the respective right wheels 13, 14, the right side of unit 30 is prevented from rolling forward or backward.

Except for the wheel locks 70 and the relative positioning of the pivoting pivot pins 38*a*, 38*b* and the wheel assembly journals 35*a*, 15*a*, the right wheel support 12 is the same as the left wheel support 32 that is shown in FIG. 11K. As shown in FIG. 11N, it is important that the pivoting pivot pins 38*a*, 38*b* be disposed between the wheel assembly journals 35*a*, 15*a* and the rear end 21 of the generator. The rear end 21 of the generator unit 30 has the rear support legs 16 on the ends of the vertical rear legs 21*a*, 21*b* of the frame 20, FIG. 5 shows an alternative arrangement for pivotally connecting each of the wheel assemblies 11, 31 to a respective side of the frame 20. In the alternative arrangement shown in FIG. 5, a dead axle is non-rotatably mounted to each bottom rail, and each of the wheel assemblies 11, 31 defines a bearing that is configured to rotatably receive therein one of the dead axles on one of the frame's bottom rails. Thus, as shown in FIG. 5, a right dead axle 15 can be mounted to the right bottom rail 23 at the lower portion of the right side of the frame 20. The right wheel support 12 desirably is configured to rotate about the right dead axle 15. Similarly, as shown in FIG. 5 for example, a left dead axle 35 can be mounted to the left bottom rail 24 at the lower portion of the left side of the frame 20. The left wheel support 32 desirably is configured to rotate about the left dead axle 35.

Each dead axle 15, 35 will be located in the same respective location along the respective lower rail 23, 24 of the frame as were the locations of the respective bearings 17, 18 already described above in the presently preferred embodiments of pivotally connecting the wheel assemblies 11, 31 to the frame. As shown in FIG. 5 for example, the dead axles 15, 35 will be disposed between the front end 22 of the frame 20 and the center of gravity of the overall unit 30 with a full tank of fuel. With these locations of the dead axles 15, 35, each of the right wheel assembly 11 and left wheel assembly 31 will become pivotally mounted to the frame 20 such that the pivot points facilitate maneuvering over rough terrain with a full tank of fuel. Moreover, each of the right wheel assembly 11 and left wheel assembly 31 desirably pivots independently of the other wheel assembly. Thus, each of the right wheel assembly 11 and left wheel assembly 31 can negotiate over relatively raised obstructions or through depressions in the path independently of each other.

Figure 6:
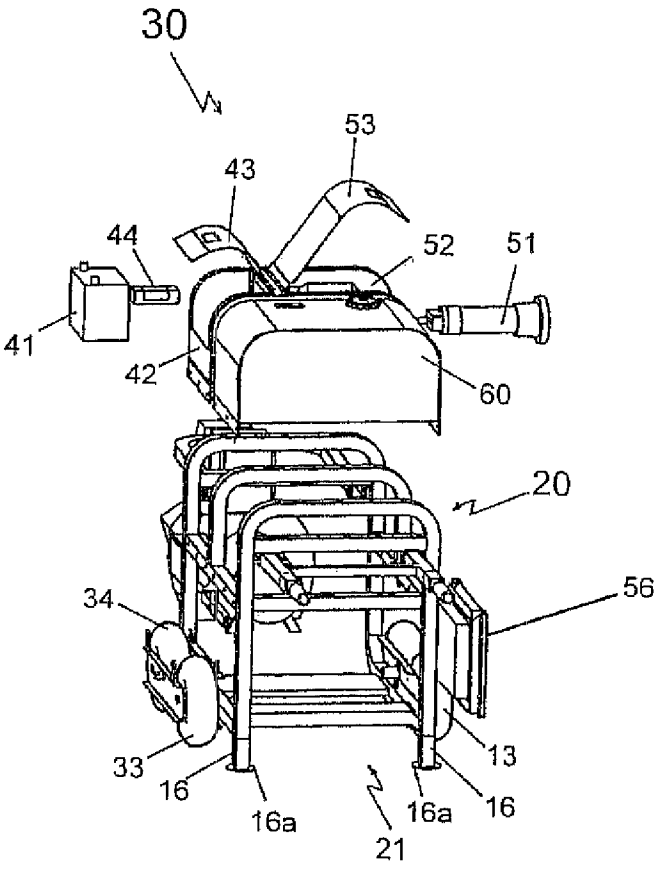
FIG. 6 is an elevated perspective view from the rear of components of a partially assembled, preferred embodiment of the wheeled, manually movable, internal combustion engine powered electric generator of the present invention.

Opposite the front end 22 of the frame 20 having the dead axles 15, 35 and wheels 13, 14, 33, 34, and as shown in FIGS. 1 and 6 for example, the rear end 21 of the frame 20 typically will have a pair of stationary vertical support legs 16 to carry the other portion of the weight of the generator unit 30. Each support leg 16 desirably is provided with a support foot 16*a* fixed at the free end of each support leg 16. Each support foot 16*a* desirably is configured with more surface area to rest against the ground than the free end of the support leg 16 to which the support foot 16*a* is attached.

Figure 8:
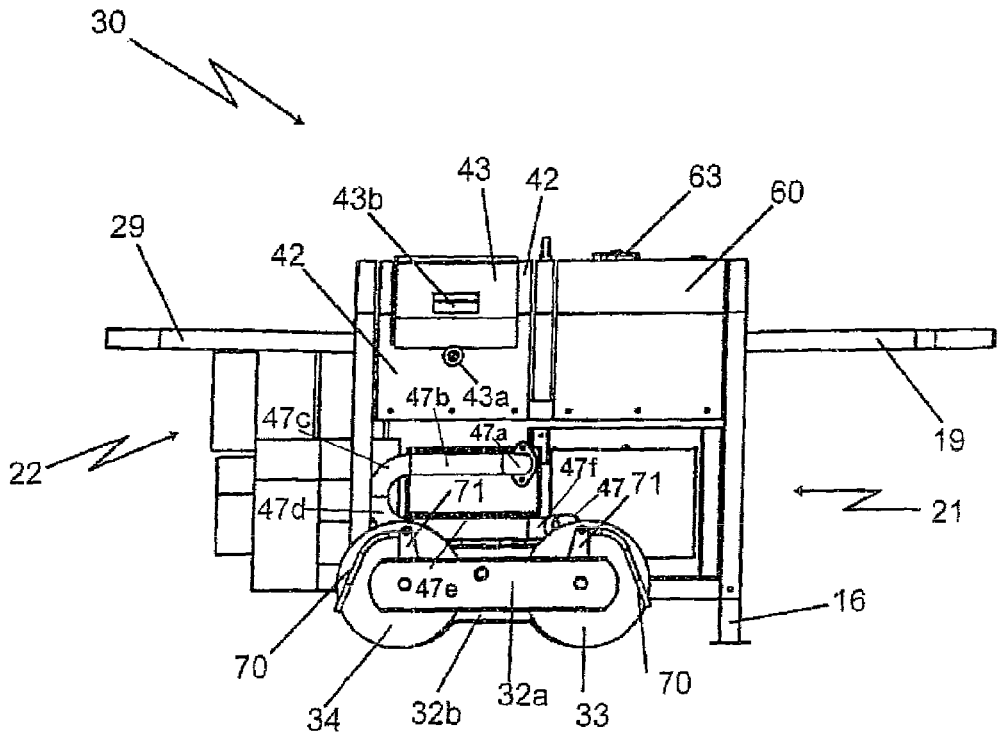
FIG. 8 is a head-on view of the left side of components of a partially assembled, embodiment of the wheeled, manually movable, internal combustion engine powered electric generator of the present invention.
Figure 11O:
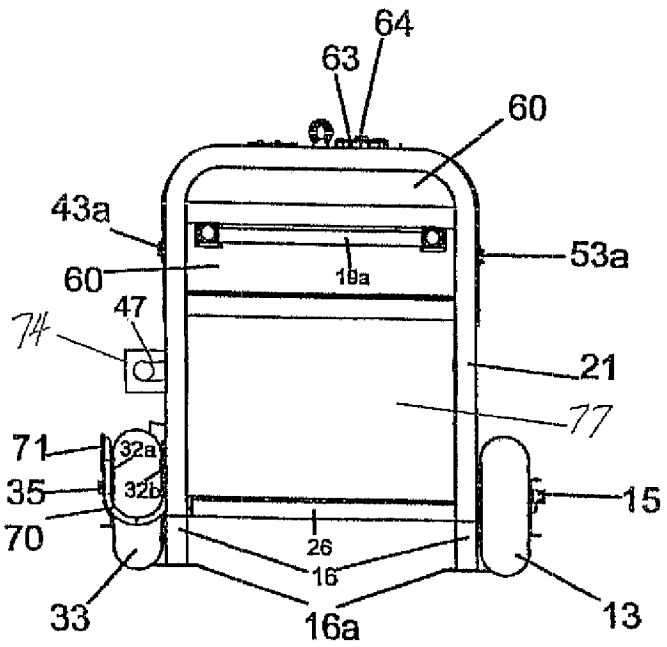
FIG. 11O is a plan view from the rear of a presently preferred embodiment of the wheeled, manually movable, internal combustion engine powered electric generator of the present invention.

As shown in FIG. 7 for example, the muffler 46 on the internal combustion engine desirably is disposed behind the engine 40 and within the lower section of the frame and beneath the upper outline of the internal combustion engine 40 in order to free space for accommodating the fuel tank 60. As shown in FIGS. 1 and 2 for example, the engine's muffler 46 is mounted along one side of the housing 50 for the electric stator and rotor and desirably includes a discharge pipe 47 that discharges to the side of the generator unit 30. As shown in FIGS. 1, 2 and 8 for example, the discharge pipe 47 can be generally U-shaped and can begin with a 90° turn 47*a* out of the muffler 46 and can continue toward the front in a forward straight section 47*b*. Then as shown in FIG. 2, the discharge pipe 47 can make a U-turn to form the bottom of the U-shape by connecting two 90° turns 47*c* and 47*d* and can continue toward the rear in a rearward straight section 47*e*. At the end of the rearward straight section 47*e*, the discharge pipe 47 makes a final 90° turn 47*f* that directs the exhaust to exit from the side of the generator unit 30. The generally U-shaped discharge pipe 47 is found to assist in dampening the sound of the gaseous discharge that exits the pipe 47. As shown in FIG. 11O, for example, a side exhaust housing 74 is provided to shield the final 90° turn 47*f* of the discharge pipe 47 from damage.

As shown in FIGS. 11O, 12A and 12B, a back panel 77 is provided for the generator, and the interior facing surface of the back panel 77 facing the generator is provided with a layer of sound insulating material. Moreover, the interior facing surface of the lower left side panel 75 (shown in FIG. 11H for example) is also provided with sound insulating material that muffles the noise of the operating generator.

As shown in FIGS. 1 and 2 for example, the air filter 48 for the internal combustion engine 40 desirably can be provided with an inwardly facing air intake scoop 49. With the air intake scoop 49 of the air filter 48 facing inwardly toward the engine 40, it is believed that the sounds of the air rushing into and through the filter 48 and the noises generated by the operation of the engine 40 tend at least partially to cancel one another and thereby significantly diminish the noise that overall is generated by operation of the internal combustion engine 40.

As shown in FIG. 1, an electrical output connector 51 is provided and configured to electrically connect the electrical output produced by the generator to the electrical load such as batteries that are to be recharged for example. As shown in FIG. 2, a power cord or transmission cable 54 is provided having one end connected to the electrical output connector 51. An opposite end of the power cord 54 is electrically connected to the generator in conventional fashion. As schematically shown in FIG. 3 for example, the electric connector 51 is electrically connected to the electric generator via the electric power transmission cable 54 and an electric control panel 56. As shown in FIGS. 3, 4, 5, 11G and 12A for example, the control panel 56 for the connector 51 is housed on one side of the frame 20.

Figure 4:
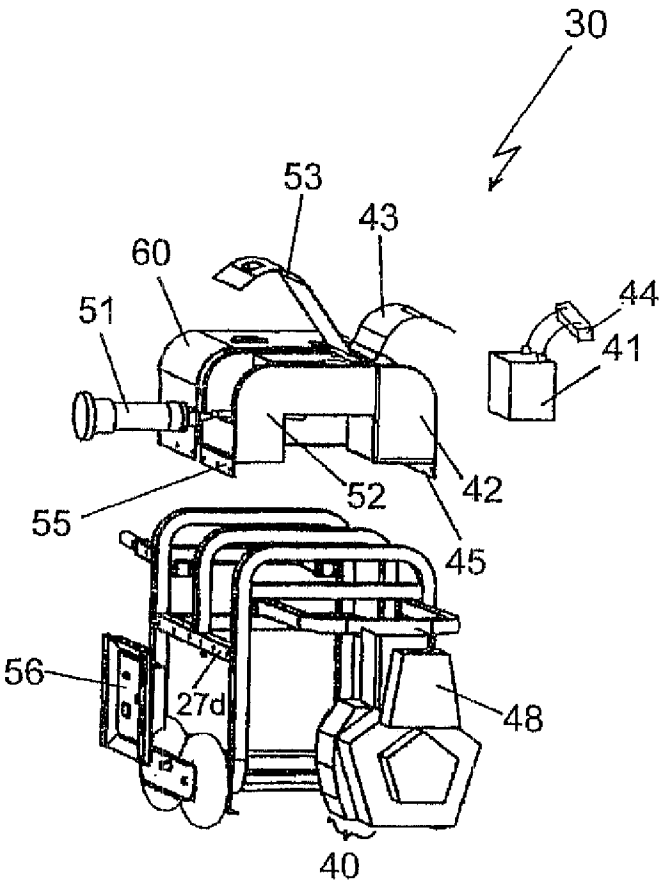
FIG. 4 is an elevated perspective view of the front right of assembled components of a partially assembled, preferred embodiment of the wheeled, manually movable, internal combustion engine powered electric generator of the present invention.
Figure 11P:
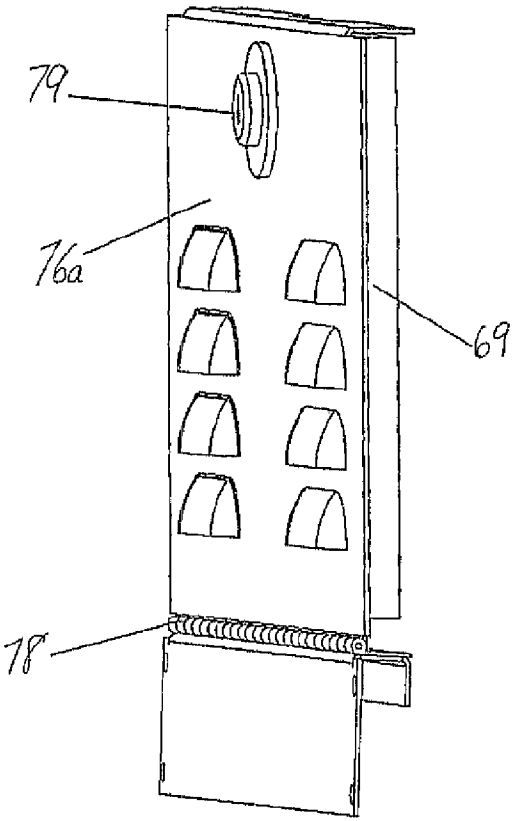
FIG. 11P is an elevated perspective front view of a hinged compartment door component of a presently preferred embodiment of the wheeled, manually movable, internal combustion engine powered electric generator of the present invention.
Figure 11Q:
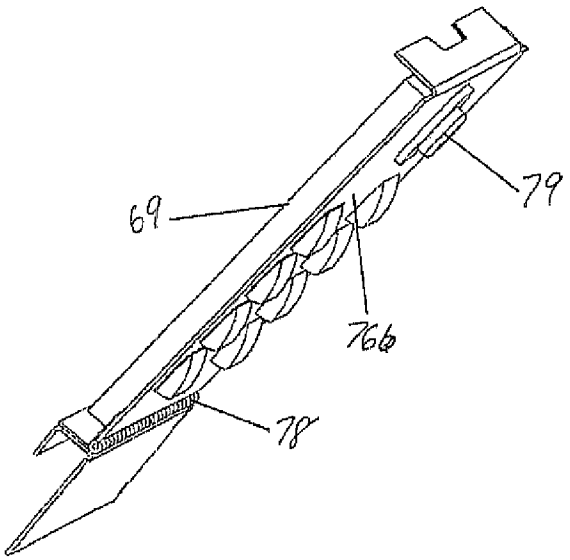
FIG. 11Q is an elevated perspective side view of a hinged compartment door component of a presently preferred embodiment of the wheeled, manually movable, internal combustion engine powered electric generator of the present invention.
Figure 11R:
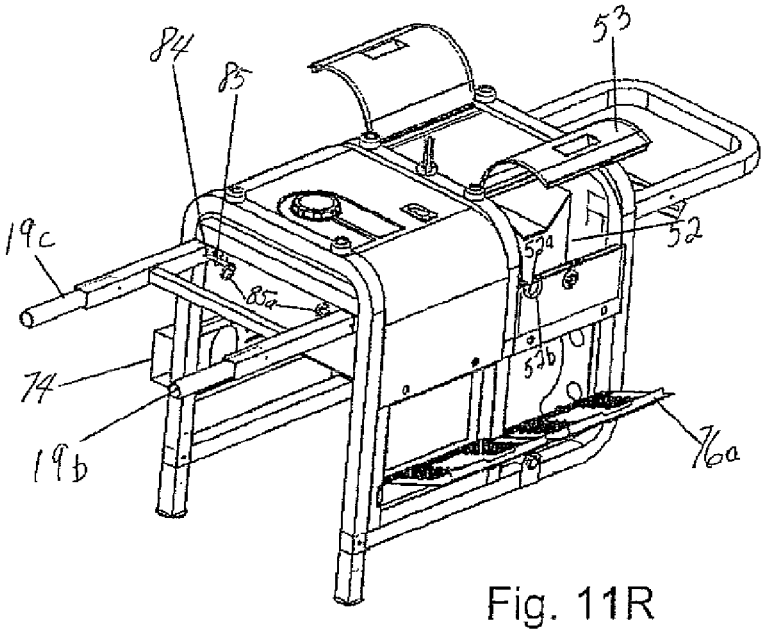
FIG. 11R is an elevated perspective view of from the rear and right side of assembled components of a partially assembled, presently preferred embodiment of the wheeled, manually movable, internal combustion engine powered electric generator of the present invention.
Figure 11S:
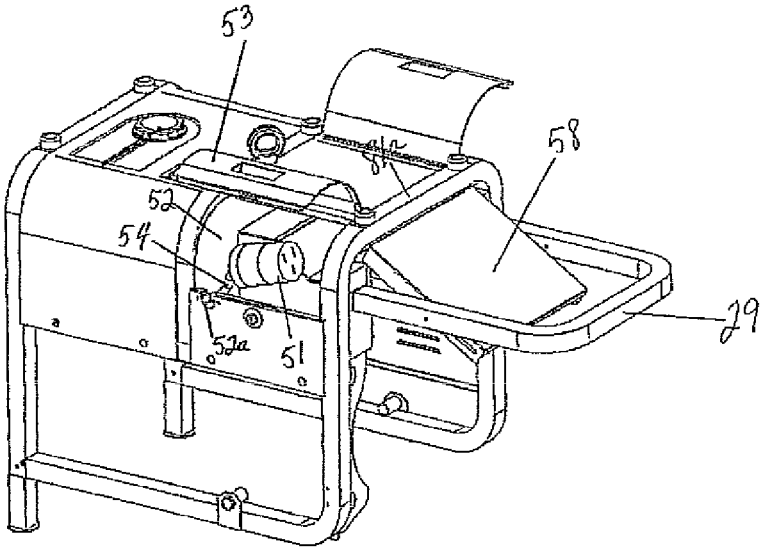
FIG. 11S is an elevated perspective view of from the right side and front of assembled components of a partially assembled, presently preferred embodiment of the wheeled, manually movable, internal combustion engine powered electric generator of the present invention.

As shown in FIGS. 3 and 4 for example, the upper front portion of the frame 20 also supports and contains a power compartment 52 that is carried by the frame. As shown in FIG. 4 for example, the power compartment 52 can be provided with a lower attachment flange 55 that can be secured to a front section 27*d* of a horizontal mid brace of the frame 20. The power compartment 52 desirably nests between the upper portion of the front end 22 of the frame 20 and the vertical mid brace 28 of the frame 20. As shown in FIG. 11S for example, the power compartment 52 defines a storage space that selectively houses the electrical output connector 51 and the power transmission cable or cord 54. The power compartment 52 also defines an opening providing access to the storage space. The interior of the power compartment 52 also desirably is provided with an additional empty volume of space that can be used for storing items in addition to the electrical output connector 51 and the power transmission cable or cord 54.

Figure 9:
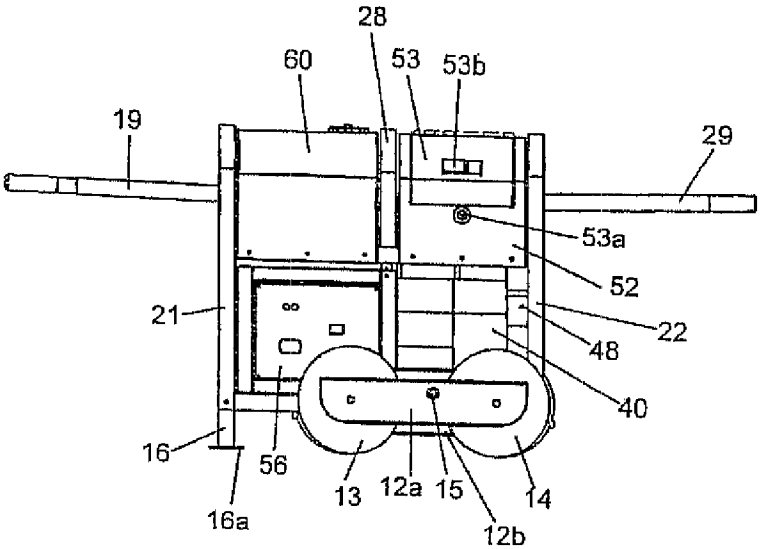
FIG. 9 is a head-on view of the right side of components of a partially assembled, embodiment of the wheeled, manually movable, internal combustion engine powered electric generator of the present invention.

As shown in FIGS. 1-4 and 11S for example, the power compartment 52 desirably includes a door in the form of a hinged cover 53 connected to the power compartment and selectively closing and exposing the opening that provides access to the interior of the power compartment 52. The power compartment 52 desirably includes a locking mechanism for selectively locking the door 53 in a position closing the opening in the power compartment 52. As shown in FIG. 9 for example, a locking mechanism 53*a* desirably is provided that locks the hinged cover 53 and thereby secures the power compartment 52 in the closed position. As shown in FIG. 9 for example, a recessed hand hold 53*b* can be provided in the hinged cover 53 to facilitate manually raising and lowering the cover 53.

Figure 11T:
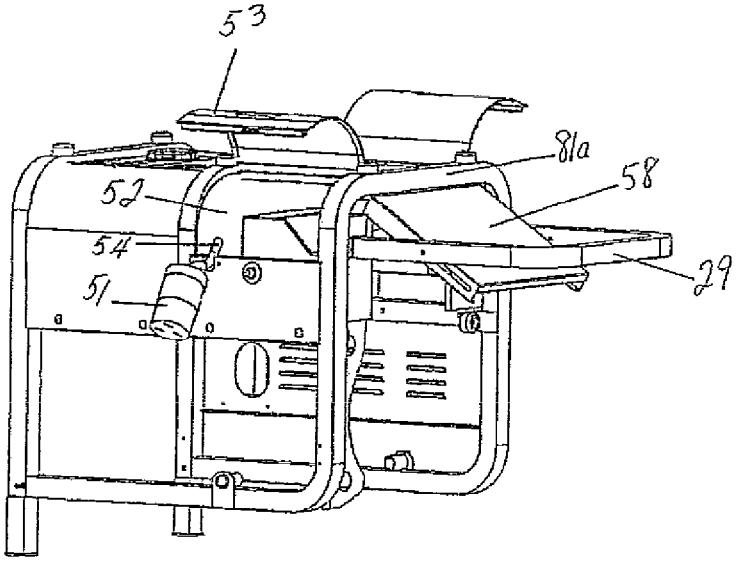
FIG. 11T is an elevated perspective view of from the right side and front of assembled components of a partially assembled, presently preferred embodiment of the wheeled, manually movable, internal combustion engine powered electric generator of the present invention.

In an advantageous feature of an embodiment of the present invention, to discourage tampering with whatever items might be stored within the power compartment 52, the power compartment 52 further defines a front wall portion that is configured to permit the cover 53 to be closed and locked while the connector 51 and power cord 54 are disposed outside the power compartment 52 and connected to supply electric power to a load. As shown in each of FIGS. 11F, 11R and 11S for example, an opening 52*a* is provided in the front wall portion of the connector compartment 52. As shown in FIGS. 11S and 11T for example, the opening 52*a* allows the electric connector 51 to be disposed outside of the connector compartment 52 while the hinged covering door 53 of the connector compartment 52 becomes locked in the closed position. As shown in FIG. 11R for example, a saddle 52*b* is provided around the opening 52*a*. The saddle 52*b* is configured to receive and cradle the electric power transmission cable 54 without danger of abrading or cutting the electrical insulation that defines the exterior surfaces of the cable 54 when the door 53 to the connector compartment 52 is closed.

As shown in FIG. 1 for example, a direct current battery 41 for the internal combustion engine 40 desirably is carried above the engine 40 by the upper portion of the front end 22 of the frame 20 and connected to the engine 40 in a conventional fashion. As shown in FIG. 1, a battery compartment 42 defines an interior space and an opening providing access to the interior space where the battery 41 desirably is housed. The battery compartment 42 desirably can be provided with a lower attachment flange 45 that can be secured to a front section 27*c* of a horizontal mid brace of the frame 20. The battery compartment 42 desirably nests between the upper portion of the front end 22 of the frame 20 and the vertical mid brace 28 of the frame 20. As shown in FIGS. 8 and 10, the battery compartment 42 desirably is mounted to the upper front section of the frame 20 flush with the uppermost elements of the frame 20 and completely within the outer envelope that defines the frame 20.

The battery compartment 42 desirably is provided with a hinged cover 43 that is connected to the battery compartment and can be manipulated for selectively closing and exposing the opening that exposes the interior of the battery compartment 42. As shown in FIG. 8 for example, a recessed hand hold 43*b* can be provided in the hinged cover 43 to facilitate manually raising and lowering the cover 43. As shown in FIG. 8 for example, a locking mechanism 43*a* desirably is provided that locks the hinged cover 43 and thereby secures the battery compartment 42 in the closed position. By being disposed within the battery compartment 42 with the cover 43 closed and locked, the battery 41 desirably is secured for protection against theft when the unit 30 is deployed at an unattended location.

Desirably, as shown in FIGS. 4 and 6 for example, a trickle charger 44 for the battery 41 also can be housed within the battery compartment 42 and electrically connected to the battery 41. The trickle charger 44 keeps the battery 41 from discharging during periods when the unit 30 is going to remain in storage for any relevant length of time. FIGS. 1 and 2 are assembly views that show the battery 41 and trickle charger 44 outside of the compartment 42 and before the compartment 42 has been mounted into the frame 20.

As shown in FIG. 5 for example, a selectively retractable front handle 29 is mounted pivotally to the upper portion of the front end 22 of the frame 20. One function of this front handle 29 is to facilitate lifting of the unit 30 when necessary to negotiate past obstacles that cannot be negotiated solely by using the rear handle 19 to push or pull the generator unit 30 on the wheels 13, 14, 33, 34. Though not shown in FIG. 5, the front handle 29 can be selectively retracted from its extended orientation shown in FIG. 5 to a position in which the front handle 29 lies flush with the front end 22 of the frame 20. The front handle 29 can include an end brace 29*a* connecting a right front handle leg 29*b* that extends parallel to and spaced apart from a left front handle leg 29*c*.

In another advantageous feature of an embodiment of the present invention, a locking front panel desirably is connected to the front handle 29 and configured to enable the user to selectively lock the front handle 29 in a fully extended horizontal position. FIG. 11A is an elevated perspective view from the front left side of the main frame 20, which has been stripped away of most components in order to illustrate better, the front handle 29 and the locking front panel 58. As shown in each of FIGS. 11A and 11C for example, the locking front panel 58 is configured so that when the user positions the front panel 58 to lock the front handle 29 in the fully extended horizontal position, the user may release the user's grip on the front handle 29 without fear that the handle 29 will pivot downwardly to fully retract to the vertical position against the front 22 of the generator's frame 20. In the view shown in FIG. 11D, the front handle 29 has not been attached to the frame 20, and thus it is easier to see that the locking front panel 58 is pivotally mounted to the underside of the front upper crossbrace 81*a* of the front of the frame 20. As shown in FIG. 11E, pivoting hinges 58*a* can be provided at one end of the locking front panel 58 for pivotally attaching the locking front panel 58 to the front upper crossbrace 81*a*. Moreover, as further shown in FIG. 11E, a layer 58*b* of sound insulating material is desirably provided to line the underside of the locking front panel 58.

As shown in FIG. 11E, an elongated slot 59 extends part way along the length of each opposite sidewall 58*c* of the locking front panel 58. Each slot 59 defines a first end 59*a*, which begins very near the end of the front panel 58 disposed away from the end that is pivotally mounted by the hinges 58*a*. As shown in FIG. 11E, each slot 59 terminates just short of half way along the length of the panel 58. As shown in FIG. 11E, the end of each slot that terminates just short of half way along the length of the panel 58 defines a locking leg 59*b* that is formed in the shape of the up-turned portion of the letter J.

As shown in FIG. 11C, a guide bar 29*d* is mounted to extend from the side of the right front handle leg 29*b* of the front handle 29, and a guide bar 29*d* is mounted to extend from the side of the left front handle leg 29*c* of the front handle 29. Each guide bar 29*d* is slideably fitted within a respective one of the slots 59 formed in the sidewalls 59*c* of the locking front panel 58. When the front handle 29 is in the vertical position resting against the front end 22 of the frame, each guide bar 29*d* is positioned at the starting end 59*a* of the respective slot 59 of the locking front panel 58 nearest the end opposite the end where the hinges 58*a* are located. As the front handle 29 is raised from this vertical position into the horizontal position shown in FIGS. 11A, 11B, 11C, 11F, 11G, 11H and 11I, each guide bar 29*d* moves in the slot 59 toward the hinged end of the locking front panel 58 until the respective guide bar 29*d* is engaged by the user in the locking leg 59*b* portion of the end of the slot 59. Once the two guide bars 29*d* are resting in the locking leg 59*b* portions of the end of the slots 59, then the front handle 29 becomes locked in the horizontal position shown in each of FIGS. 11A, 11B, 11C, 11F, 11G, 11H and 11I.

As shown in FIG. 2 for example, a retractable, rear handle 19 is pivotally mounted to be extendable from the upper portion of the rear end 21 of the frame 20. Though not shown in FIG. 2, the rear handle 19 can be selectively retracted from its extended orientation shown in FIG. 2 to a position in which the rear handle 19 lies flush with the rear end 21 of the frame 20. The rear handle 19 can include at least one forward cross brace 19*a* connecting a right grip handle 19*b* that extends parallel to and spaced apart from a left grip handle 19*c*. As shown in FIG. 5 for example, the rear handle 19 is pivotally mounted to the rear end 21 of the frame 20 by pivotally mounting one end of the right grip handle 19*b* to the upper end of the right vertical rear leg 21*a* of frame 20 and pivotally mounting one end of the left grip handle 19*c* to the upper end of the left vertical rear leg 21*b* of frame 20.

As shown in FIG. 11R, the rear dual handles 19*b*, 19*c* can be locked in the upright horizontal position so that when the user stops gripping the handles 19*b*, 19*c*, they cannot fall from the horizontal position to the vertical position, which is shown in FIG. 12A for example. Desirably, the frame and the ends of the handles 19*b*, 19*c* that are pivotally mounted to the frame can be provided with selectively alignable through holes that are configured to receive therein a locking pin that selectively can be put into place manually when the rear dual handles 19*b*, 19*c* are deployed in the horizontal position. In this way, when the user lets go of the handles, the handles will not pivot downwardly against the rear end of the frame. As shown in FIG. 11R for example, the end of the left handle grip 19*c* that is pivotally mounted to the frame can be provided with a transversely extending through hole 84 that is configured to receive therein the shaft of a locking pin 85 having a ring on one end configured to receive the user's finger.

As shown in FIG. 11A for example, each of the uppermost surfaces of the upper crossbraces 81*a*, 81*b*, 81*c* of the frame 20 desirably carries a pair of stacking disks 80, which desirably are resilient and skid resistant such as sturdy rubber disks 80 that facilitate one generator being stacked on top of another generator during shipping. The weight of the generator 30 with an empty fuel tank 60 and without the wheel assemblies 11, 31 attached, is about 300 pounds, and so the six disks 80 must be capable of withstanding at least this weight without degrading. Each disk 80 in the pair is spaced apart from the other disk 80 and desirably is as widely spaced apart as possible while still resting on a horizontal upper surface of the respective crossbrace 81*a*, 81*b*, 81*c*. The stacking disks 80 enable one generator 30 to be stacked on top of another generator 30 during shipping once the left and right wheel assemblies 31, 11 temporarily have been removed.

As shown in FIG. 11A, a threaded opening 82*a* desirably is provided vertically through the mid upper crossbrace 81*b*. The threaded opening 82*a* desirably is configured for selectively detachably receiving a threaded end of a bolt portion of a lifting eye fixture 82, which is shown in FIG. 11B for example. The lifting eye fixture 82 facilitates lifting the generator 30 with a crane. The lifting eye fixture 82 is configured to be selectively detachable by being unscrewed from the threaded opening 82*a* formed in the mid upper crossbrace 81*b*. Detaching the lifting eye fixture 82 facilitates the stacking of one generator 30 on top of another generator 30, prior to shipping.

A hand guard panel desirably is attached to the end of the frame nearer the internal combustion engine. The hand guard panel desirably is ventilated to facilitate air circulation to and from the engine while still shielding the user from coming into contact with the engine. As shown in FIGS. 11A, 11F and 11J, a ventilated hand guard panel 89 is attached to the front right vertical leg 22*a* of the frame along one edge thereof. The hand guard panel 89 also desirably is provided with a plurality of openings 89*a* that facilitate air circulation to and from the engine. However, each opening 89*a* is not so large that a person could put a hand through the opening 89 and be harmed by operation of the internal combustion engine of the generator.

As shown in FIG. 11A, for example, the vertical distance from the lowermost surfaces 23*b*, 24*b* of the respective bottom rails 23, 24 to the uppermost surfaces of the uppermost elements of the frame such as the upper surface of the front upper crossbrace 81*a* for example, desirably measures no more than about 25½ inches in height. When all four wheels are fully installed on the frame, the distance from the portion of the wheel touching the ground to the uppermost surfaces of the uppermost elements of the frame such as the upper surface of the front upper crossbrace 81*a* for example, desirably measures no more than about 29½ inches high. In such an embodiment, the horizontal length between the forwardmost edge of each front vertical leg 22*a*, 22*b* and the rearwardmost edge of each respective rear vertical leg 21*a*, 21*b* desirably measures no more than about 29⅛ inches long. The distance between the leftmost surface of the front left vertical leg 22*b* and the rightmost surface of the right vertical leg 22*a* desirably measures no more than about 21½ inches wide.

As shown in FIGS. 11G and 12C for example, the control panel 56 desirably is provided with an on/off switch 68. As shown in FIGS. 11P and 11Q for example, each of the front lower right side panel 76*a* and rear lower right side panel 76*b* can be provided with a hinge 78 at one edge thereof and a keyed lock 79 disposed toward the opposite edge thereof. As shown in FIG. 11G for example, each of the hinged and lock-bearing side panels 76*a*, 76*b* desirably provides a door that selectively governs access respectively to the run/stop switch of the generator and the on/off switch 68 for the connector 51. In this way, access is controlled by a respective generator door 76*a*, 76*b* that can be locked in the closed position to prevent outside access respectively to the generator run/stop switch and the on/off switch 68 for the connector 51. As shown in FIGS. 11P and 11Q for example, the inside surface of each generator door 76*a*, 76*b* desirably also is insulated with sound deadening material 69 to reduce the noise of the operating generator. The locked generator doors 76*a*, 76*b* serve to prevent tampering with the operation of the generator once the generator is running to generate electricity.

In another advantageous feature of an embodiment of the present invention, a single key desirably operates the all of the respective locking mechanisms 53*a*, 64, 43*a*, 79 for the power compartment 52, the fuel cap 63, the battery compartment 42 and the generator doors 76*a*, 76*b*.

While at least one presently preferred embodiment of the invention has been described using specific terms, such description is for illustrative purposes only, and it is to be understood that changes and variations may be made without departing from the spirit or scope of the invention.

What is claimed is:

1. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel; and a second wheel assembly connected to said second side of said frame and rotatably carrying at least a second wheel, and wherein:

said first wheel assembly including a first inner wheel support plate defining an outer side and an inner side disposed opposite said outer side, said first wheel assembly including a front wheel axle extending from said outer side of said first inner wheel support plate, said first wheel assembly including a rear wheel axle extending from said outer side of said first inner wheel support plate and spaced apart from said front wheel axle, said first wheel assembly including a first wheel assembly journal extending from said inner side of said first inner wheel support plate and extending in a transverse direction parallel to said front wheel axle and said rear wheel axle, said first wheel assembly journal being pivotally connected to said first side of said frame; and said second wheel assembly including a second inner wheel support plate defining an outer side and an inner side disposed opposite said outer side, said second wheel assembly including a front wheel axle extending from said outer side of said second inner wheel support plate, said second wheel assembly including a rear wheel axle extending from said outer side of said second inner wheel support plate and spaced apart from said front wheel axle, said second wheel assembly including a second wheel assembly journal extending from said inner side of said second inner wheel support plate and extending parallel to said front wheel axle and said rear wheel axle, said second wheel assembly journal being pivotally connected to said second side of said frame.

2. An apparatus as in claim 1, wherein:

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly.

3. An apparatus as in claim 2, wherein:

said first front wheel of said first wheel assembly is spaced apart in said axial direction of said frame from said first rear wheel of said first wheel assembly.

4. An apparatus as in claim 1, wherein:

said first wheel assembly including a first pivot pin extending from said inner side of said first inner wheel support plate of said first wheel assembly and disposed closer to said rear wheel axle of said first wheel assembly than to said front wheel axle of said first wheel assembly; and said second wheel assembly including a second pivot pin extending from said second inner side of said inner wheel support plate of said second wheel assembly and disposed closer to said rear wheel axle of said second wheel assembly than to said front wheel axle of said second wheel assembly.

5. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel; and said first wheel assembly including a first pivot pin extending transversely from said first wheel assembly and disposed to engage said frame and lift one end of said first wheel assembly with respect to the ground when one end of said frame is lifted a predetermined distance above the ground.

6. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and wherein said fuel tank has a capacity of at least twelve gallons and the uppermost outline of said fuel tank is disposed essentially flush with the uppermost outline of said frame.

7. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel, said first wheel assembly including a first pivot pin extending transversely from said first wheel assembly and disposed to engage said frame and lift one end of said first wheel assembly with respect to the ground when one end of said frame is lifted a predetermined distance above the ground;

a control panel carried by said frame, said control panel having an on/off switch for controlling the flow of electric power from said generator;

a control panel cover pivotally connected to said frame, said control panel cover being configured to be selectively disposable over said control panel; and a keyed lock mounted to at least one of said control panel cover or said frame and configured for securing said control panel cover over said control panel.

8. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and a first quick-disconnect member selectively connected to said first wheel assembly and configured to selectively permit quickly disconnecting said first wheel assembly from said first side of said frame.

9. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine; and a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and a first wheel locking mechanism selectively disposable to prevent rotation of said first wheel, said first wheel locking mechanism including a U-shaped rod having two opposed free ends pivotally connected to said first wheel assembly.

10. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and the internal combustion engine further including an exhaust outlet, an exhaust pipe and an exhaust muffler having one end connected to the exhaust pipe and an opposite end connected to the exhaust outlet, the exhaust muffler being disposed beneath the upper outline of the engine, the exhaust pipe being disposed toward one side of said frame.

11. An apparatus as in claim 10, further comprising:

an exhaust housing mounted to one side of said frame and configured to shield said exhaust pipe from damaging contact.

12. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and the internal combustion engine further including an air filter having an intake scoop with the inlet opening of the intake scoop facing inwardly toward the engine.

13. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel, said first wheel assembly including a first pivot pin extending transversely from said first wheel assembly and disposed to engage said frame and lift one end of said first wheel assembly with respect to the ground when one end of said frame is lifted a predetermined distance above the ground;

an electrical output connector and an electric power cord carried by said frame, said power cord having one end connected to said electrical output connector and an opposite end connected to said generator; and a power compartment carried by said frame and defining a storage space and an opening providing access to said storage space, said power compartment including a door connected to said power compartment and selectively closing and exposing said opening, said power compartment including a locking mechanism for selectively locking said door in a position closing said opening in said power compartment, said electrical output connector and electric power cord being selectively disposed within said storage space of said power compartment, said power compartment further defining a front wall portion that is configured to permit the door to be closed and locked while the connector is disposed outside the power compartment and connected to supply electric power to a load.

14. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel, said first wheel assembly including a first pivot pin extending transversely from said first wheel assembly and disposed to engage said frame and lift one end of said first wheel assembly with respect to the ground when one end of said frame is lifted a predetermined distance above the ground;

a battery carried by said frame and electrically connected to said engine;

a trickle charger carried by said frame and electrically connected to said battery; and a battery compartment carried by said frame and defining an interior space and an opening providing access to said interior space, said battery compartment including a door connected to said battery compartment and selectively closing and exposing said opening, said battery compartment including a locking mechanism for selectively locking said door in a position closing said opening in said battery compartment, said battery and trickle charger being selectively disposed within said interior space of said battery compartment.

15. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a redetermined distance above the ground;

a front handle selectively pivotally mounted to the front end of the frame to pivot between a fully extended horizontal position and a retracted vertical position; and a locking front panel connected to the front handle and configured to enable the user to selectively lock the front handle in the fully extended horizontal position.

16. An apparatus as in claim 15, further comprising:

a layer of sound insulating material disposed along an interior surface of said locking front panel in a manner that attenuates the noise of the generator when the front handle and locking front panel are retracted to their positions against the front of the frame.

17. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground;

a rear handle selectively retractably mounted to the rear end of the frame; and a locking mechanism configured for selectively locking said rear handle in the upright horizontal position so that when the user stops gripping the rear handle, the rear handle remains in the upright horizontal position, said locking mechanism including selectively alignable through holes defined through said rear handle and said frame, said locking mechanism including a pin selectively disposable through said alignable through holes.

18. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground;

at least one upper crossbrace extending transversely between said frame's first side and second side wherein said crossbrace defines an uppermost surface; and at least two spaced apart and resilient and skid resistant stacking disks connected to said uppermost surface of said crossbrace.

19. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel;

said first wheel assembly including a first pivot pin extending transversely from said first wheel assembly and disposed to engage said frame and lift one end of said first wheel assembly with respect to the ground when one end of said frame is lifted a predetermined distance above the ground; and a hand guard panel attached to the end the frame nearer the internal combustion engine and defining a plurality of openings that facilitate air circulation but are not so large that an adult person could put one's hands through the openings.

20. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side, said frame including at least one upper crossbrace extending transversely between said frame's first side and second side wherein said crossbrace defines an uppermost surface;

a first wheel assembly and a second wheel assembly, said first wheel assembly being pivotally connected to said first side of said frame and said second wheel assembly being pivotally connected to said second side of said frame;

said first wheel assembly including a first front wheel rotatably mounted to said first heel assembly and a first rear wheel rotatably mounted to said first wheel assembly, said second wheel assembly including a second front wheel rotatably mounted to said second wheel assembly and a second rear wheel rotatably mounted to said second wheel assembly;

said first wheel assembly including a first quick-disconnect member configured to selectively permit quickly disconnecting said first wheel assembly from said first side of said frame, said second wheel assembly including a second quick-disconnect member configured to selectively permit quickly disconnecting said second wheel assembly from said second side of said frame;

said first wheel assembly including an inner wheel support plate defining an outer side and an inner side disposed opposite said outer side, said first wheel assembly including a front wheel axle extending from said outer side of said inner wheel support plate, said first wheel assembly including a rear wheel axle extending from said outer side of said inner wheel support plate and spaced apart from said front wheel axle, said first wheel assembly including a first wheel assembly journal extending from said inner side of said inner wheel support plate and extending in a transverse direction parallel to said front wheel axle and said rear wheel axle;

said first wheel assembly including a first pivot pin extending from said inner side of said inner wheel support plate of said first wheel assembly and disposed closer to said rear wheel axle of said first wheel assembly than to said front wheel axle of said first wheel assembly;

said second wheel assembly including an inner wheel support plate defining an outer side and an inner side disposed opposite said outer side, said second wheel assembly including a front wheel axle extending from said outer side of said inner wheel support plate, said second wheel assembly including a rear wheel axle extending from said outer side of said inner wheel support plate and spaced apart from said front wheel axle, said second wheel assembly including a second wheel assembly journal extending from said inner side of said inner wheel support plate and disposed symmetrically with respect to said front wheel axle and said rear wheel axle;

said second wheel assembly including a second pivot pin extending from said inner side of said inner wheel support plate of said second wheel assembly and disposed closer to said rear wheel axle of said second wheel assembly than to said front wheel axle of said second wheel assembly;

a first wheel locking mechanism connected to said first wheel assembly and selectively disposable to prevent rotation of at least one of said first front wheel and said first rear wheel, said first including wheel locking mechanism a first U-shaped rod having two opposed free ends pivotally connected to said first wheel assembly and selectively disposable to prevent rotation of one of said first front wheel or said first rear wheel, said first U-shaped rod having a closed loop portion opposite the two free ends opposed to each other, said first U-shaped rod defining an intermediate section disposed between the opposed free ends and the closed loop portion, said intermediate section being bent at an angle relative to the plane in which the closed loop portion of the U-shaped rod resides;

an internal combustion engine carried by said frame and including a rotatable output shaft;

the internal combustion engine further including an exhaust outlet, an exhaust pipe and an exhaust muffler having one end connected to the exhaust pipe and an opposite end connected to the exhaust outlet, the exhaust muffler being disposed beneath the upper outline of the engine, the exhaust pipe being disposed toward one side of said frame;

an exhaust housing mounted to one side of said frame and configured to shield said exhaust pipe from damaging contact;

the internal combustion engine further including an air filter having an intake scoop facing inwardly toward the engine;

a fuel tank and a fuel line carried by said frame and disposed completely within the frame, said fuel line having one end connected to said engine and an opposite end connected to said fuel tank, said fuel tank defining an inlet and including a cap configured for selective connection to said inlet of said fuel tank;

an electric generator carried by said frame and including a stator and a rotor, said rotor being rotatably disposed with respect to said stator and connected to said engine's rotatable output shaft;

a control panel carried by said frame and a control panel cover pivotally connected to said frame and selectively disposable over said control panel, which is provided with an on/off switch, said control panel cover having a keyed lock for securing said control panel cover over said control panel;

an electrical output connector and an electric power cord carried by said frame, said power cord having one end connected to said electrical output connector and an opposite end connected to said generator via said control panel;

a power compartment carried by said frame and defining a storage space and an opening providing access to said storage space, said power compartment including a door connected to said power compartment and selectively closing and exposing said opening, said power compartment including a locking mechanism for selectively locking said door in a position closing said opening in said power compartment, said electrical output connector and electric power cord being selectively disposed within said storage space of said power compartment, said power compartment further defining a front wall portion that is configured to permit the cover to be closed and locked while the connector is disposed outside the power compartment and connected to supply electric power to a load;

a battery carried by said frame and electrically connected to said engine, and a trickle charger carried by said frame and electrically connected to said battery;

a battery compartment carried by said frame and defining an interior space and an opening providing access to said interior space, said battery compartment including a door connected to said battery compartment and selectively closing and exposing said opening, said battery compartment including a locking mechanism for selectively locking said door in a position closing said opening in said battery compartment, said battery and trickle charger being selectively disposed within said interior space of said battery compartment;

a front handle selectively retractably mounted to the front end of the frame;

a locking front panel connected to the front handle and configured to enable the user to selectively lock the front handle in a fully extended horizontal position, a layer of sound insulating material disposed along an interior surface of said locking front panel in a manner that attenuates the noise of the generator when the front handle and locking front panel are retracted to their positions against the front of the frame;

a rear handle selectively retractably mounted to the rear end of the frame;

a locking mechanism configured for selectively locking said rear handle in the upright horizontal position so that when the user stops gripping the rear handle, the rear handle remains in the upright horizontal position;

said frame includes at least one upper crossbrace extending transversely between said frame's first side and second side wherein said crossbrace defines an uppermost surface carrying at least two spaced apart and resilient and skid resistant stacking disks that facilitate one generator to be stacked on top of another generator during shipping;

a hand guard panel attached to the front end the frame near the internal combustion engine and defining a plurality of openings that facilitate air circulation but are not so large that a person could put one's hands through the openings; and at least two spaced apart and resilient and skid resistant stacking disks connected to said uppermost surface of said crossbrace.

* * * * *